US009308434B2

(12) United States Patent
Ostor

(10) Patent No.: US 9,308,434 B2
(45) Date of Patent: Apr. 12, 2016

(54) COLLAPSIBLE SNOWSHOE

(76) Inventor: Pierre Ostor, Homer, AK (US)

( * ) Notice: Subject to any disclaimer, the term of this patent is extended or adjusted under 35 U.S.C. 154(b) by 358 days.

(21) Appl. No.: 13/315,177

(22) Filed: Dec. 8, 2011

(65) Prior Publication Data

US 2013/0145654 A1 Jun. 13, 2013

(51) Int. Cl.
*A63C 13/00* (2006.01)

(52) U.S. Cl.
CPC ..... *A63C 13/005* (2013.01); *A63C 13/001* (2013.01); *A63C 13/003* (2013.01); *A63C 2203/10* (2013.01)

(58) Field of Classification Search
CPC .... A63C 13/00; A63C 13/001; A63C 13/003; A63C 13/005; A63C 2203/10
USPC ..... 36/122, 123, 124, 125
See application file for complete search history.

(56) References Cited

U.S. PATENT DOCUMENTS

| | | | | | |
|---|---|---|---|---|---|
| 405,516 | A | * | 6/1889 | Watson | 36/122 |
| 3,555,707 | A | * | 1/1971 | Sharrat et al. | 36/123 |
| 3,619,915 | A | * | 11/1971 | Cheney | 36/122 |
| 4,203,236 | A | | 5/1980 | Erickson et al. | |
| 4,720,927 | A | | 1/1988 | Abegg | |
| 5,309,652 | A | * | 5/1994 | Campbell | 36/124 |
| 5,459,950 | A | | 10/1995 | Damm et al. | |
| 5,718,068 | A | | 2/1998 | Sawyer et al. | |
| 5,829,173 | A | | 11/1998 | Svetlik et al. | |
| 6,564,478 | B1 | | 5/2003 | Wing et al. | |
| 6,763,617 | B1 | | 7/2004 | Stafford | |
| 7,331,129 | B1 | | 2/2008 | Chapman et al. | |
| 8,006,412 | B2 | | 8/2011 | Kreutzer et al. | |
| 2008/0134544 | A1 | * | 6/2008 | Kreutzer et al. | 36/123 |

* cited by examiner

*Primary Examiner* — Khoa Huynh
*Assistant Examiner* — Sharon M Prange
(74) *Attorney, Agent, or Firm* — Mitchell A. Rossman; Terra Nova Patent Law, PLLC

(57) ABSTRACT

The present invention provides a collapsible snowshoe. The collapsible snowshoe includes an optional guard member, an optional deck, two or more removable support members, one or more cross members, a snowshoe binding, an optional connector, and one or more crampons. Methods of using the collapsible snowshoe are also provided.

2 Claims, 24 Drawing Sheets

COLLAPSIBLE SNOWSHOE

BACKGROUND OF THE INVENTION

Snowshoes are useful for walking across deep snow. Winter travelers in motor vehicles, snowmobiles, and small aircrafts typically carry snowshoes in the event they become stranded and need to walk across deep snow to obtain help. Snowshoes are generally too large to store in a motor vehicle, snow machine, or small aircraft for only emergency use. Further, if lashed to the exterior of a snow machine, snowshoes may even present a collision hazard if they extend over the sides of the snowmobile or if they fall off the snowmobile onto the trail.

Snowmobilers are particularly at risk when traveling in the snow covered wilderness. Lives can be saved by having snowshoes when stranded in deep snow. However, conventional snowshoes fail to provide users with requisite versatility by lacking compactness, convenience, and low-cost. Additionally, conventional snowshoes typically are incapable of being collapsed.

Early versions of collapsible snowshoes have been complicated in design and difficult to assemble in an emergency. The last thing that users need in an emergency is a collapsible snowshoe that is complicated to assemble and includes various parts that could get lost in the snow during assembly.

As such, there is a need for a snowshoe that is collapsible, versatile, light-weight, compact, easy to assemble and provides its user with adequate floatation, articulation, control, and traction.

SUMMARY OF THE INVENTION

The present invention provides a snowshoe having both a compact stored configuration and a usable configuration. When in its compact stored configuration, the snowshoe is particularly adapted for storage until a situation arises requiring the use of the snowshoes.

The collapsible snowshoe can be stored in a small space, and be used for emergencies, for example, by car drivers stranded during a winter storm, snow machine riders with a mechanical failure, adventurers, armed forces, or any outdoor enthusiast. The collapsible snowshoe is easy to manufacture, cost effective, and reliable.

The present invention also provides a collapsible snowshoe that is also flexible because the collapsible snowshoe does not have a rigid frame or fully connected frame. This flexibility provides improved performance allowing the user to ascend steep slopes without any difficulty.

The present invention provides a collapsible snowshoe. The collapsible snowshoe includes:

an optional guard member having a first surface and a second surface, wherein the optional guard member is connected to a front lateral edge of an optional deck having a first surface, a second surface, a first edge, a second edge, a front lateral edge, and a rear lateral edge, wherein the optional deck is optionally configured to receive two or more removable support members along the first edge and the second edge, or wherein the optional guard member is optionally configured to receive two or more removable support members, wherein the two or more removable support members each independently contain one or more retainers;

one or more cross members each independently having a first surface and a second surface, wherein the one or more cross members are each independently connected transversely to the first surface of the optional deck or wherein the one or more cross members are each independently configured to receive the two or more removable support members;

a snowshoe binding connected transversely to one or more of the one or more cross members, wherein a front of the snowshoe binding is oriented toward the optional guard member;

an optional connector operatively coupled to the first surface of the optional guard member or the first surface of the optional deck and to the snowshoe binding, the first surface of the optional deck, one or more cross members, or a combination thereof; and one or more crampons connected to the second surface of the optional deck, to one or more second surfaces of the one or more cross members, or to a lower surface of the snowshoe binding, provided that when the optional deck is present, the optional guard member is present and connected to the front lateral edge of the optional deck and the optional connector is present and operatively coupled to the first surface of the optional guard member and to the snowshoe binding, the first surface of the optional deck, one or more cross members, or a combination thereof, provided that when the optional guard member is not present, the optional deck is present and the optional connector is operatively coupled to the first surface of the optional deck and to the snowshoe binding, the first surface of the optional deck, one or more cross members, or a combination thereof, provided that when the optional deck is not present, the optional guard member is present and is configured to receive one or more removable support members, the optional connector is not present, and the one or more cross members are each independently configured to receive one or more removable support members.

In one embodiment, the optional deck includes a first sleeve along the first edge and a second sleeve along the second edge for receiving the two or more removable support members. In one embodiment, the first sleeve along the first edge and the second sleeve along the second edge are prepared by welding, soldering, gluing, stapling, sewing, riveting, buttoning, or a combination thereof. In one embodiment, the optional deck includes one or more flexible materials. In one embodiment, the one or more flexible materials each independently include neoprene, nylon, animal hide, Kevlar, polyester, polyethylene, silk, cotton, polypropylene, metal, or a combination thereof.

In one embodiment, the optional deck includes one or more rigid materials. In one embodiment, the one or more rigid materials each independently include aluminum, titanium, stainless steel, fiberglass, fiber, wood, steel, magnesium, carbon-fiber, magnesium-lithium alloy, plastic, or a combination thereof. In one embodiment, the optional deck includes a combination of one or more flexible materials and one or more rigid materials.

In one embodiment, the optional deck includes a waterproof material. In one embodiment, the two or more removable support members each independently include aluminum, titanium, stainless steel, fiberglass, fiber, wood, steel, magnesium, carbon-fiber, magnesium-lithium alloy, plastic, or a combination thereof. In one embodiment, the two or more removable support members are collapsible support members. In one embodiment, the two or more removable support members are non-collapsible support members.

In one embodiment, the two or more removable support members are rigid support members. In one embodiment, the two or more removable support members are flexible support members. In one embodiment, the optional guard member includes a rigid material. In one embodiment, the optional guard member includes a non-rigid material.

In one embodiment, the optional guard member includes aluminum, titanium, stainless steel, fiberglass, fiber, wood, steel, magnesium, carbon-fiber, magnesium-lithium alloy, plastic, or a combination thereof.

In one embodiment, the one or more cross members each independently include aluminum, titanium, stainless steel, fiberglass, fiber, wood, steel, magnesium, carbon-fiber, magnesium-lithium alloy, plastic, or a combination thereof.

In one embodiment, the one or more cross members each independently include a rigid material. In one embodiment, the one or more cross members each independently include a non-rigid material. In one embodiment, the connector further includes a connector member, a lanyard, and a lanyard retainer. In one embodiment, the snowshoe binding is connected transversely to one cross member and allowed to pivot forward about the one cross member. In one embodiment, the one crampon is connected to a lower surface of the snowshoe binding. In one embodiment, the one or more retainers include a snap button, a fitted cap, a fitted tube, or a combination thereof.

The present invention provides a collapsible snowshoe. The collapsible snowshoe includes:

a guard member having a first surface and a second surface, wherein the guard member is connected to a front lateral edge of a deck having a first surface, a second surface, a first longitudinal edge, a second longitudinal edge, a front lateral edge, and a rear lateral edge, wherein the deck is configured to receive two or more removable longitudinal support members along the first longitudinal edge and the second longitudinal edge, wherein the two or more removable longitudinal support members each independently contain one or more retainers;

one or more cross members each independently having a first surface and a second surface, wherein the one or more cross members are each independently connected transversely to the first surface of the deck;

a snowshoe binding connected transversely to one or more of the one or more cross members, wherein a front of the snowshoe binding is oriented toward the guard member;

a connector operatively coupled to the first surface of the guard member to the snowshoe binding, the first surface of the deck, one or more cross members, or a combination thereof; and one or more crampons connected to the second surface of the deck.

The present invention provides a collapsible snowshoe. The collapsible snowshoe includes:

a guard member having a first surface and a second surface, wherein the guard member is connected to a front lateral edge of a deck having a first surface, a second surface, a first longitudinal edge, a second longitudinal edge, a front lateral edge, and a rear lateral edge, wherein the deck is configured to receive two or more removable longitudinal support members along the first longitudinal edge and the second longitudinal edge, wherein the deck includes a first longitudinal sleeve along the first longitudinal edge and a second longitudinal sleeve along the second longitudinal edge for receiving the two or more removable longitudinal support members, wherein the two or more removable longitudinal support members each independently contain one or more retainers;

one or more cross members each independently having a first surface and a second surface, wherein the one or more cross members are each independently connected transversely to the first surface of the deck;

a snowshoe binding connected transversely to one or more of the one or more cross members, wherein a front of the snowshoe binding is oriented toward the guard member;

a connector operatively coupled to the first surface of the guard member to the snowshoe binding, the first surface of the deck, one or more cross members, or a combination thereof, wherein the connector includes a connector member, a lanyard, and a lanyard retainer; and one or more crampons connected to the second surface of the deck.

In one embodiment, the optional deck includes a first longitudinal sleeve along the first longitudinal edge and a second longitudinal sleeve along the second longitudinal edge for receiving the two or more removable longitudinal support members. In one embodiment, the first longitudinal sleeve along the first longitudinal edge and the second longitudinal sleeve along the second longitudinal edge are prepared by welding, soldering, gluing, stapling, sewing, riveting, buttoning, or a combination thereof.

The present invention provides a collapsible snowshoe. The collapsible snowshoe includes:

a deck having a first surface, a second surface, a first longitudinal edge, a second longitudinal edge, a front lateral edge, and a rear lateral edge, one or more cross members each independently having a first surface and a second surface, wherein the one or more cross members are each independently connected to the first surface of the deck, wherein the one or more cross members are each independently configured to receive the two or more removable longitudinal support members, wherein the two or more removable longitudinal support members each independently contain one or more retainers;

a snowshoe binding connected transversely to one or more of the one or more cross members;

a connector operatively coupled to the first surface of the front lateral edge of the deck and to the snowshoe binding, one or more cross members, or a combination thereof; and one or more crampons connected to the second surface of the deck.

The present invention provides a collapsible snowshoe. The collapsible snowshoe includes:

a deck having a first surface, a second surface, a first longitudinal edge, a second longitudinal edge, a front lateral edge, and a rear lateral edge, one or more cross members each independently having a first surface and a second surface, wherein the one or more cross members are each independently connected to the first surface of the deck, wherein the one or more cross members are each independently configured to receive the two or more removable longitudinal support members, wherein the two or more removable longitudinal support members each independently contain one or more retainers;

a snowshoe binding connected transversely to one or more of the one or more cross members;

a connector operatively coupled to the first surface of the front lateral edge of the deck and to the snowshoe binding, one or more cross members, or a combination thereof, wherein the connector includes a connector member, a lanyard, and a lanyard retainer; and one or more crampons connected to the second surface of the deck.

The present invention provides a collapsible snowshoe. The collapsible snowshoe includes:

a guard member having a first surface and a second surface, wherein the guard member is configured to receive two or more removable longitudinal support members, wherein the two or more removable longitudinal support members each independently contain one or more retainers;

one or more cross members each independently having a first surface and a second surface, wherein the one or more cross members are each independently configured to receive the two or more removable longitudinal support members;

a snowshoe binding connected transversely to one or more of the one or more cross members, wherein a front of the snowshoe binding is oriented toward the guard member; and one or more crampons connected to one or more second surfaces of the one or more cross members.

The present invention provides a method of using a collapsible snowshoe. The method includes:

providing a collapsible snowshoe including:

an optional guard member having a first surface and a second surface, wherein the optional guard member is connected to a front lateral edge of an optional deck having a first surface, a second surface, a first edge, a second edge, a front lateral edge, and a rear lateral edge, wherein the optional deck is optionally configured to receive two or more removable support members along the first edge and the second edge, or wherein the optional guard member is optionally configured to receive two or more removable support members, wherein the two or more removable support members each independently contain one or more retainers;

one or more cross members each independently having a first surface and a second surface, wherein the one or more cross members are each independently connected transversely to the first surface of the optional deck or wherein the one or more cross members are each independently configured to receive the two or more removable support members;

a snowshoe binding connected transversely to one or more of the one or more cross members, wherein a front of the snowshoe binding is oriented toward the optional guard member;

an optional connector operatively coupled to the first surface of the optional guard member or the first surface of the optional deck and to the snowshoe binding, the first surface of the optional deck, one or more cross members, or a combination thereof; and one or more crampons connected to the second surface of the optional deck, to one or more second surfaces of the one or more cross members, or to a lower surface of the snowshoe binding, provided that when the optional deck is present, the optional guard member is present and connected to the front lateral edge of the optional deck and the optional connector is present and operatively coupled to the first surface of the optional guard member and to the snowshoe binding, the first surface of the optional deck, one or more cross members, or a combination thereof, provided that when the optional guard member is not present, the optional deck is present and the optional connector is operatively coupled to the first surface of the optional deck and to the snowshoe binding, the first surface of the optional deck, one or more cross members, or a combination thereof, provided that when the optional deck is not present, the optional guard member is present and is configured to receive one or more removable support members, the optional connector is not present, and the one or more cross members are each independently configured to receive one or more removable support members;

inserting the two or more removable support members each independently into the first support edge and the second support edge;

securing the two or more removable support members each independently into the first support edge and the second support edge;

inserting a user's foot into the snowshoe binding, securing the user's foot in the snowshoe binding, and walking.

The present invention provides a method of using a collapsible snowshoe. The method includes:

providing a collapsible snowshoe including:

a guard member having a first surface and a second surface, wherein the guard member is connected to a front lateral edge of a deck having a first surface, a second surface, a first longitudinal edge, a second longitudinal edge, a front lateral edge, and a rear lateral edge, wherein the deck is configured to receive two or more removable longitudinal support members along the first longitudinal edge and the second longitudinal edge, wherein the two or more removable longitudinal support members each independently contain one or more retainers;

one or more cross members each independently having a first surface and a second surface, wherein the one or more cross members are each independently connected transversely to the first surface of the deck;

a snowshoe binding connected transversely to one or more of the one or more cross members, wherein a front of the snowshoe binding is oriented toward the guard member;

a connector operatively coupled to the first surface of the guard member to the snowshoe binding, the first surface of the deck, one or more cross members, or a combination thereof; and one or more crampons connected to the second surface of the deck;

inserting the two or more removable longitudinal support members each independently into the first longitudinal edge and the second longitudinal edge;

securing the two or more removable longitudinal support members each independently into the first longitudinal edge and the second longitudinal edge;

inserting a user's foot into the snowshoe binding, securing the user's foot in the snowshoe binding, and walking.

The present invention provides a method of using a collapsible snowshoe. The method includes:

providing a collapsible snowshoe including:

a deck having a first surface, a second surface, a first longitudinal edge, a second longitudinal edge, a front lateral edge, and a rear lateral edge, one or more cross members each independently having a first surface and a second surface, wherein the one or more cross members are each independently connected to the first surface of the deck, wherein the one or more cross members are each independently configured to receive the two or more removable longitudinal support members, wherein the two or more removable longitudinal support members each independently contain one or more retainers;

a snowshoe binding connected transversely to one or more of the one or more cross members;

a connector operatively coupled to the first surface of the front lateral edge of the deck and to the snowshoe binding, one or more cross members, or a combination thereof; and one or more crampons connected to the second surface of the deck;

inserting the two or more removable longitudinal support members each independently into the one or more cross members;

securing the two or more removable longitudinal support members each independently into the one or more cross members;

inserting a user's foot into the snowshoe binding, securing the user's foot in the snowshoe binding, and walking.

The present invention provides a method of using a collapsible snowshoe. The method includes:

providing a collapsible snowshoe including:

a guard member having a first surface and a second surface, wherein the guard member is configured to receive two or more removable longitudinal support members, wherein the two or more removable longitudinal support members each independently contain one or more retainers;

one or more cross members each independently having a first surface and a second surface, wherein the one or more cross members are each independently configured to receive the two or more removable longitudinal support members;

a snowshoe binding connected transversely to one or more of the one or more cross members, wherein a front of the snowshoe binding is oriented toward the guard member; and one or more crampons connected to one or more second surfaces of the one or more cross members;

inserting the two or more removable longitudinal support members each independently into the one or more cross members;

securing the two or more removable longitudinal support members each independently into the one or more cross members;

inserting a user's foot into the snowshoe binding, securing the user's foot in the snowshoe binding, and walking.

The present invention provides a collapsible sled. The collapsible sled includes:

a guard member having a first surface and a second surface, wherein the guard member is connected to a front lateral edge of a deck having a first surface, a second surface, a first edge, a second edge, a front lateral edge, and a rear lateral edge; and one or more cross members each independently having a first surface and a second surface, wherein the one or more cross members are each independently configured to receive the two or more removable support members, wherein the two or more removable support members each independently contain one or more retainers.

The present invention provides a collapsible sled. The collapsible sled includes:

a guard member having a first surface and a second surface, wherein the guard member is connected to a front lateral edge of a deck having a first surface, a second surface, a first longitudinal edge, a second longitudinal edge, a front lateral edge, and a rear lateral edge; and one or more cross members each independently having a first surface and a second surface, wherein the one or more cross members are each independently configured to receive the two or more removable longitudinal support members, wherein the two or more removable longitudinal support members each independently contain one or more retainers.

In one embodiment, the deck includes a first longitudinal sleeve along the first longitudinal edge and a second longitudinal sleeve along the second longitudinal edge for receiving the two or more removable longitudinal support members.

In one embodiment, the first longitudinal sleeve along the first longitudinal edge and the second longitudinal sleeve along the second longitudinal edge are prepared by welding, soldering, gluing, stapling, sewing, riveting, buttoning, or a combination thereof. In one embodiment, the deck includes one or more flexible materials. In one embodiment, the deck includes one or more rigid materials.

In one embodiment, the deck includes a combination of one or more flexible materials and one or more rigid materials. In one embodiment, the one or more flexible materials each independently include neoprene, nylon, animal hide, Kevlar, polyester, polyethylene, silk, cotton, polypropylene, metal, or a combination thereof. In one embodiment, the one or more rigid materials each independently include aluminum, titanium, stainless steel, fiberglass, fiber, wood, steel, magnesium, carbon-fiber, magnesium-lithium alloy, plastic, or a combination thereof. In one embodiment, the deck includes a waterproof material.

In one embodiment, the two or more removable longitudinal support members each independently include aluminum, titanium, stainless steel, fiberglass, fiber, wood, steel, magnesium, carbon-fiber, magnesium-lithium alloy, plastic, or a combination thereof. In one embodiment, the two or more removable longitudinal support members are collapsible longitudinal support members. In one embodiment, the two or more removable longitudinal support members are non-collapsible longitudinal support members. In one embodiment, the two or more removable longitudinal support members are rigid longitudinal support members. In one embodiment, the two or more removable longitudinal support members are flexible longitudinal support members.

In one embodiment, the guard member includes a rigid material. In one embodiment, the guard member includes a non-rigid material. In one embodiment, the guard member includes aluminum, titanium, stainless steel, fiberglass, fiber, wood, steel, magnesium, carbon-fiber, magnesium-lithium alloy, plastic, or a combination thereof.

In one embodiment, the one or more cross members each independently include aluminum, titanium, stainless steel, fiberglass, fiber, wood, steel, magnesium, carbon-fiber, magnesium-lithium alloy, plastic, or a combination thereof. In one embodiment, the one or more cross members each independently include a rigid material.

In one embodiment, the one or more cross members each independently include a non-rigid material. In one embodiment, the one or more cross members each independently include one or more collapsible longitudinal support members. In one embodiment, the one or more cross members each independently include one or more non-collapsible longitudinal support members.

The present invention provides a collapsible sled. The collapsible sled includes:

a deck having a first surface, a second surface, a first longitudinal edge, a second longitudinal edge, a front lateral edge, and a rear lateral edge; and one or more cross members each independently having a first surface and a second surface, wherein the one or more cross members are each independently connected to the first surface of the deck, wherein the one or more cross members are each independently configured to receive the two or more removable longitudinal support members, wherein the two or more removable longitudinal support members each independently contain one or more retainers.

The present invention provides a collapsible sled. The collapsible sled includes:

a guard member having a first surface and a second surface, wherein the guard member is configured to receive two or more removable longitudinal support members; and one or more cross members each independently having a first surface and a second surface, wherein the one or more cross members are each independently configured to receive the two or more removable longitudinal support members, wherein the two or more removable longitudinal support members each independently contain one or more retainers.

The present invention provides a method of using a collapsible sled. The method includes:

a guard member having a first surface and a second surface, wherein the guard member is connected to a front lateral edge of a deck having a first surface, a second surface, a first edge, a second edge, a front lateral edge, and a rear lateral edge; and one or more cross members each independently having a first surface and a second surface, wherein the one or more cross members are each independently configured to receive the two or more removable support members, wherein the two or more removable support members each independently contain one or more retainers;

inserting the two or more removable support members each independently into the one or more cross members;

securing the two or more removable support members each independently into the one or more cross members; and sliding the secured collapsible sled along the ground.

The present invention provides a method of using a collapsible sled. The method includes:

providing a collapsible sled including:

a guard member having a first surface and a second surface, wherein the guard member is connected to a front lateral edge of a deck having a first surface, a second surface, a first longitudinal edge, a second longitudinal edge, a front lateral edge, and a rear lateral edge; and one or more cross members each independently having a first surface and a second surface, wherein the one or more cross members are each independently configured to receive the two or more removable longitudinal support members, wherein the two or more removable longitudinal support members each independently contain one or more retainers.

The present invention provides a flexible snowshoe. The flexible snowshoe includes:

an optional guard member having a first surface and a second surface, wherein the optional guard member is connected to a front lateral edge of an optional deck having a first surface, a second surface, a first edge, a second edge, a front lateral edge, and a rear lateral edge, wherein the optional deck is optionally configured to receive two or more non-removable support members along the first edge and the second edge, or wherein the optional guard member is optionally configured to receive two or more non-removable support members, wherein the two or more non-removable support members each independently contain one or more retainers;

one or more cross members each independently having a first surface and a second surface, wherein the one or more cross members are each independently connected transversely to the first surface of the optional deck or wherein the one or more cross members are each independently configured to receive the two or more non-removable support members;

a snowshoe binding connected transversely to one or more of the one or more cross members, wherein a front of the snowshoe binding is oriented toward the optional guard member;

an optional connector operatively coupled to the first surface of the optional guard member or the first surface of the optional deck and to the snowshoe binding, the first surface of the optional deck, one or more cross members, or a combination thereof; and one or more crampons connected to the second surface of the optional deck, to one or more second surfaces of the one or more cross members, or to a lower surface of the snowshoe binding, provided that when the optional deck is present, the optional guard member is present and connected to the front lateral edge of the optional deck and the optional connector is present and operatively coupled to the first surface of the optional guard member and to the snowshoe binding, the first surface of the optional deck, one or more cross members, or a combination thereof, provided that when the optional guard member is not present, the optional deck is present and the optional connector is operatively coupled to the first surface of the optional deck and to the snowshoe binding, the first surface of the optional deck, one or more cross members, or a combination thereof, provided that when the optional deck is not present, the optional guard member is present and is configured to receive one or more non-removable support members, the optional connector is not present, and the one or more cross members are each independently configured to receive one or more non-removable support members.

The present invention provides a flexible snowshoe. The flexible snowshoe includes:

a guard member having a first surface and a second surface, wherein the guard member is connected to a front lateral edge of a deck having a first surface, a second surface, a first longitudinal edge, a second longitudinal edge, a front lateral edge, and a rear lateral edge, wherein the deck is configured to receive two or more non-removable longitudinal support members along the first longitudinal edge and the second longitudinal edge, wherein the two or more non-removable longitudinal support members each independently contain one or more retainers;

one or more cross members each independently having a first surface and a second surface, wherein the one or more cross members are each independently connected transversely to the first surface of the deck;

a snowshoe binding connected transversely to one or more of the one or more cross members, wherein a front of the snowshoe binding is oriented toward the guard member;

a connector operatively coupled to the first surface of the guard member to the snowshoe binding, the first surface of the deck, one or more cross members, or a combination thereof; and one or more crampons connected to the second surface of the deck.

The present invention provides a flexible snowshoe. The flexible snowshoe includes:

a guard member having a first surface and a second surface, wherein the guard member is connected to a front lateral edge of a deck having a first surface, a second surface, a first longitudinal edge, a second longitudinal edge, a front lateral edge, and a rear lateral edge, wherein the deck is configured to receive two or more non-removable longitudinal support members along the first longitudinal edge and the second longitudinal edge, wherein the deck includes a first longitudinal sleeve along the first longitudinal edge and a second longitudinal sleeve along the second longitudinal edge for receiving the two or more non-removable longitudinal support members, wherein the two or more non-removable longitudinal support members each independently contain one or more retainers;

one or more cross members each independently having a first surface and a second surface, wherein the one or more cross members are each independently connected transversely to the first surface of the deck;

a snowshoe binding connected transversely to one or more of the one or more cross members, wherein a front of the snowshoe binding is oriented toward the guard member;

a connector operatively coupled to the first surface of the guard member to the snowshoe binding, the first surface of the deck, one or more cross members, or a combination thereof, wherein the connector includes a connector member, a lanyard, and a lanyard retainer; and one or more crampons connected to the second surface of the deck.

The present invention provides a flexible snowshoe. The flexible snowshoe includes:

a deck having a first surface, a second surface, a first longitudinal edge, a second longitudinal edge, a front lateral edge, and a rear lateral edge, one or more cross members each independently having a first surface and a second surface, wherein the one or more cross members are each independently connected to the first surface of the deck, wherein the one or more cross members are each independently configured to receive the two or more non-removable longitudinal support members, wherein the two or more non-removable longitudinal support members each independently contain one or more retainers;

a snowshoe binding connected transversely to one or more of the one or more cross members;

a connector operatively coupled to the first surface of the front lateral edge of the deck and to the snowshoe binding, one or more cross members, or a combination thereof; and one or more crampons connected to the second surface of the deck.

The present invention provides a flexible snowshoe. The flexible snowshoe includes:

a deck having a first surface, a second surface, a first longitudinal edge, a second longitudinal edge, a front lateral edge, and a rear lateral edge, one or more cross members each independently having a first surface and a second surface, wherein the one or more cross members are each independently connected to the first surface of the deck, wherein the one or more cross members are each independently configured to receive the two or more non-removable longitudinal support members, wherein the two or more non-removable longitudinal support members each independently contain one or more retainers;

a snowshoe binding connected transversely to one or more of the one or more cross members;

a connector operatively coupled to the first surface of the front lateral edge of the deck and to the snowshoe binding, one or more cross members, or a combination thereof, wherein the connector includes a connector member, a lanyard, and a lanyard retainer; and one or more crampons connected to the second surface of the deck.

The present invention provides a flexible snowshoe. The flexible snowshoe includes:

a guard member having a first surface and a second surface, wherein the guard member is configured to receive two or more non-removable longitudinal support members, wherein the two or more non-removable longitudinal support members each independently contain one or more retainers;

one or more cross members each independently having a first surface and a second surface, wherein the one or more cross members are each independently configured to receive the two or more non-removable longitudinal support members;

a snowshoe binding connected transversely to one or more of the one or more cross members, wherein a front of the snowshoe binding is oriented toward the guard member; and one or more crampons connected to one or more second surfaces of the one or more cross members.

BRIEF DESCRIPTION OF THE DRAWINGS

Embodiments of the invention may be best understood by referring to the following description and accompanying drawings, which illustrate such embodiments. In the drawings.

Figure 1:
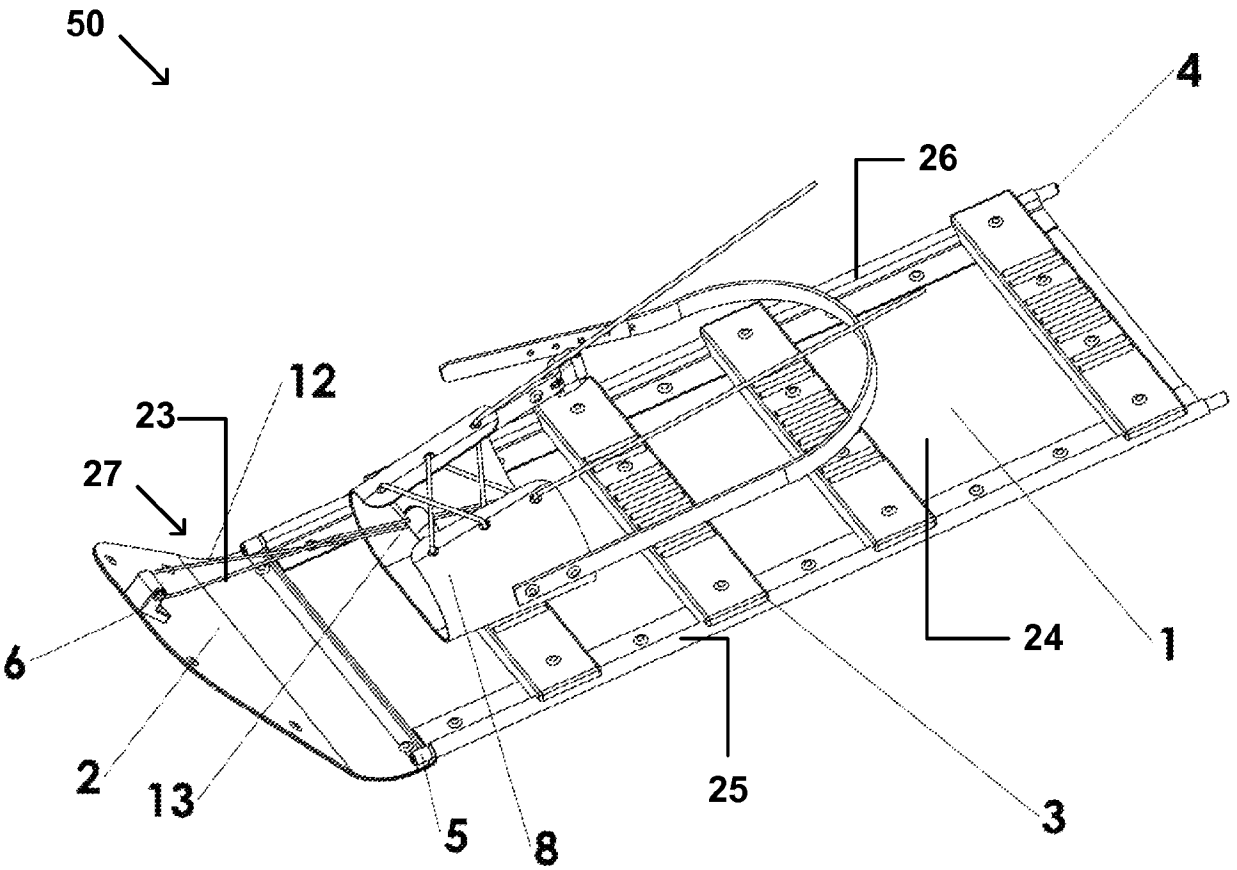
FIG. 1 is a perspective side-view drawing illustrating an exemplary collapsible snowshoe.
Figure 2:
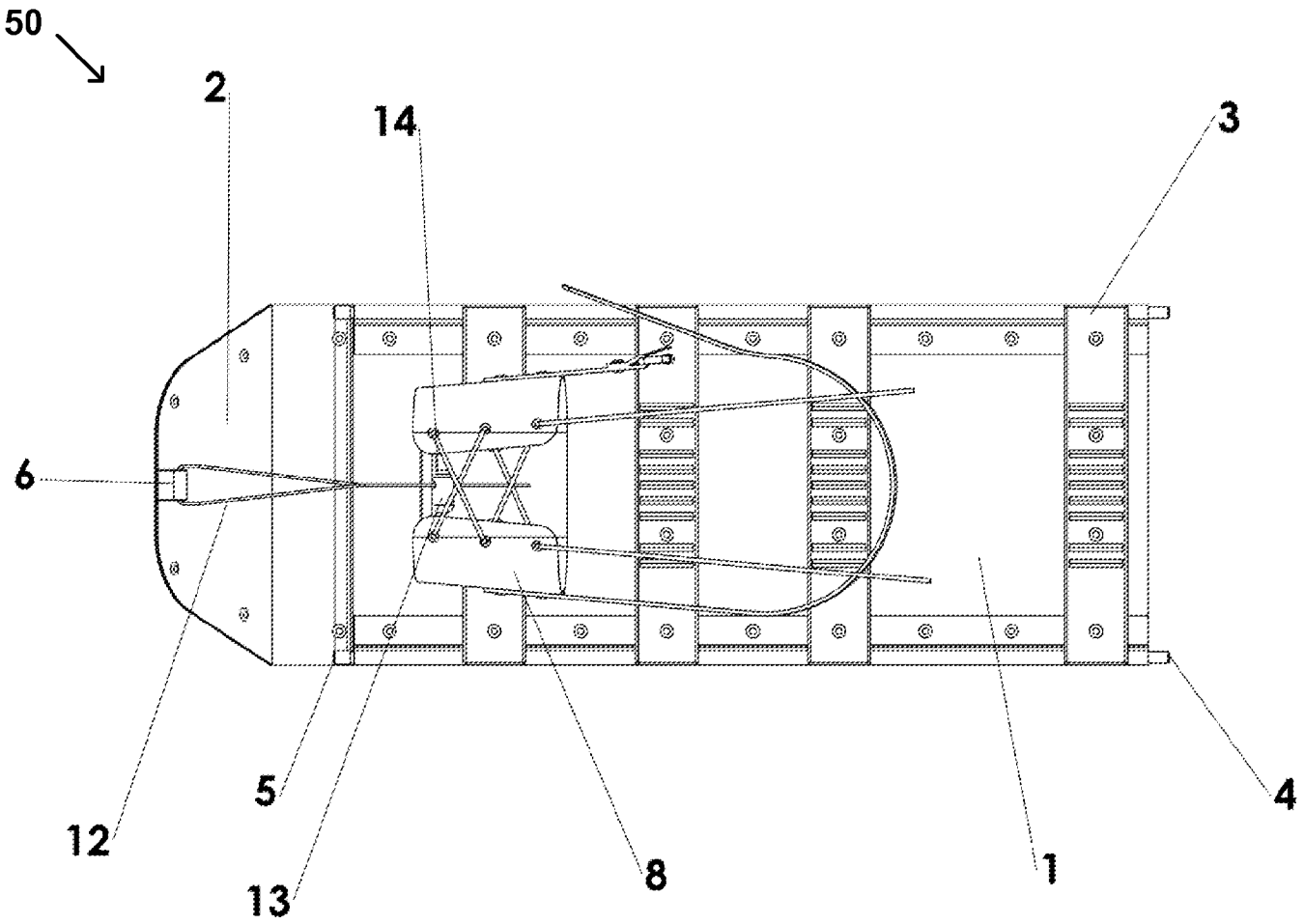
FIG. 2 is a top-view drawing illustrating an exemplary collapsible snowshoe.
Figure 3:
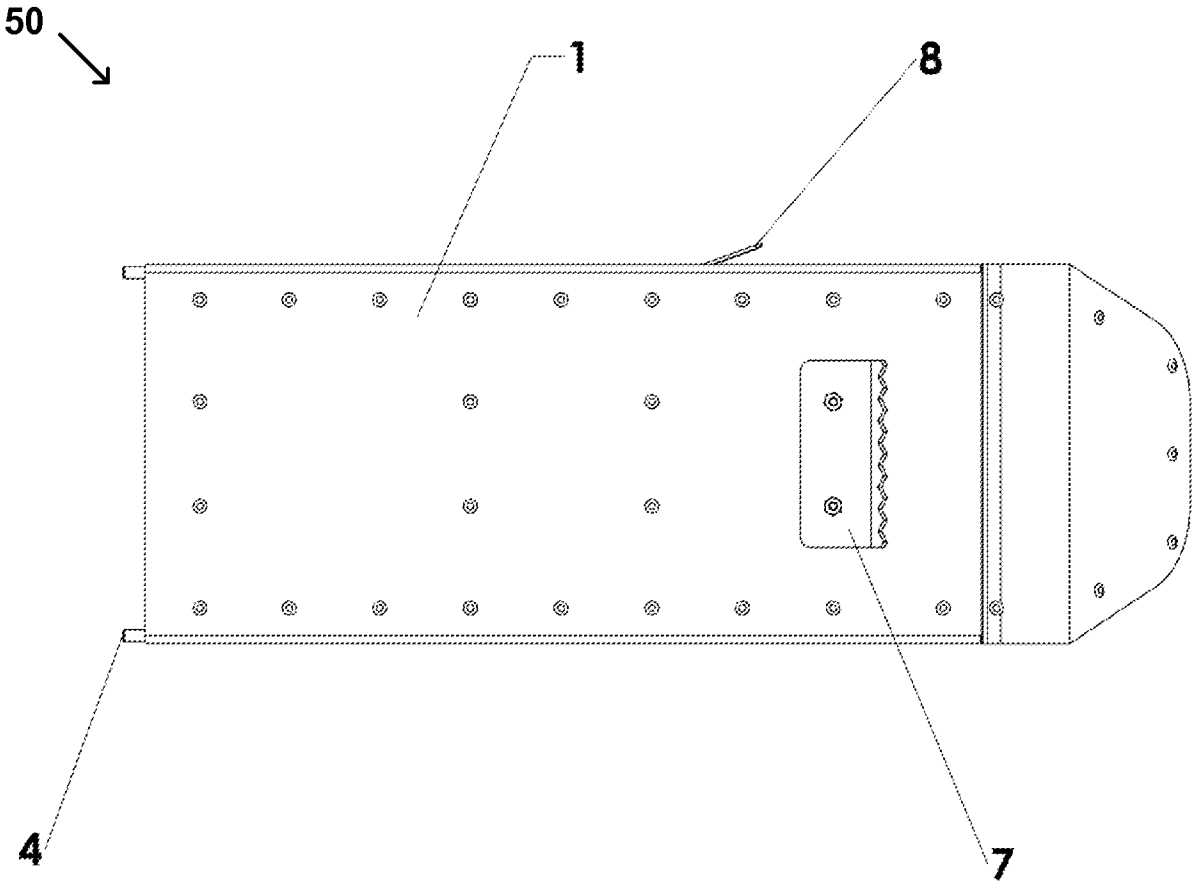
FIG. 3 is a bottom-view drawing illustrating an exemplary collapsible snowshoe.
Figure 4:
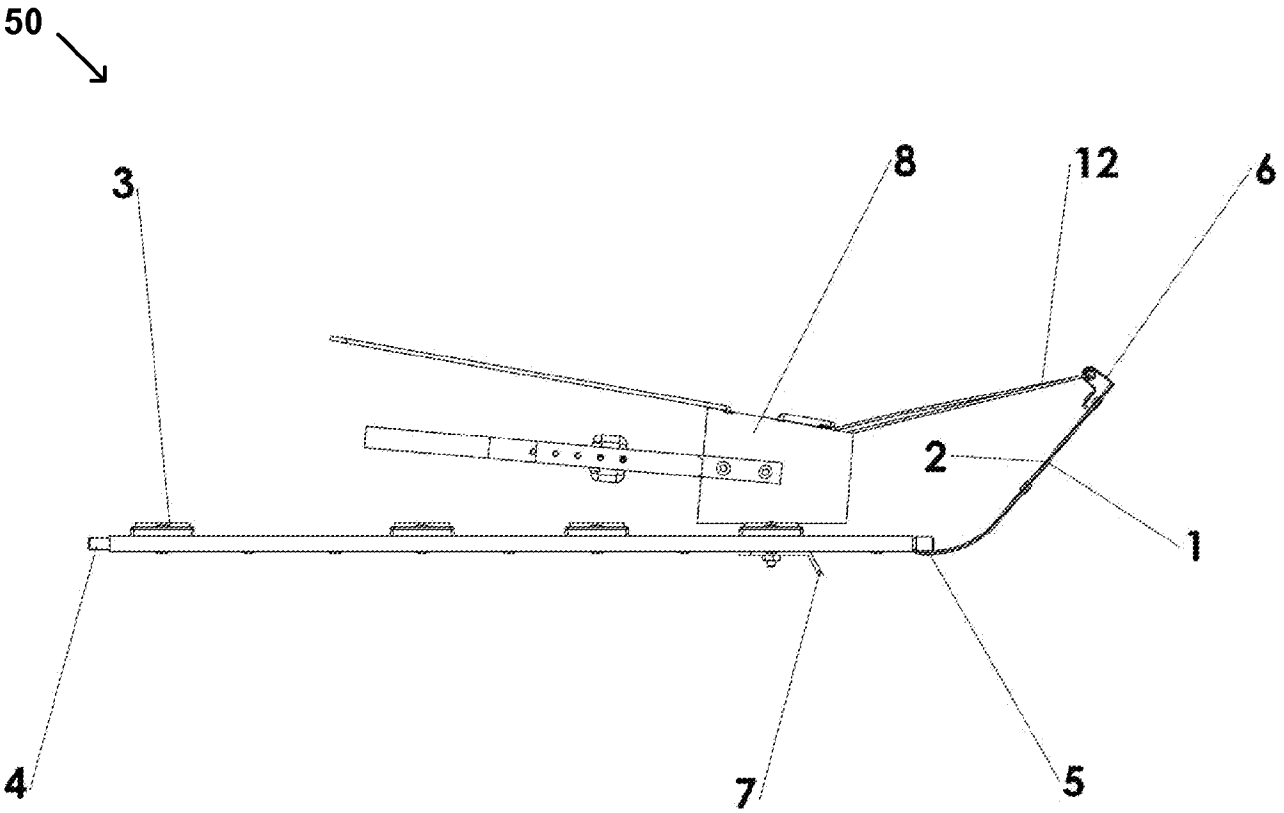
FIG. 4 is a side-view drawing illustrating an exemplary collapsible snowshoe.
Figure 5:
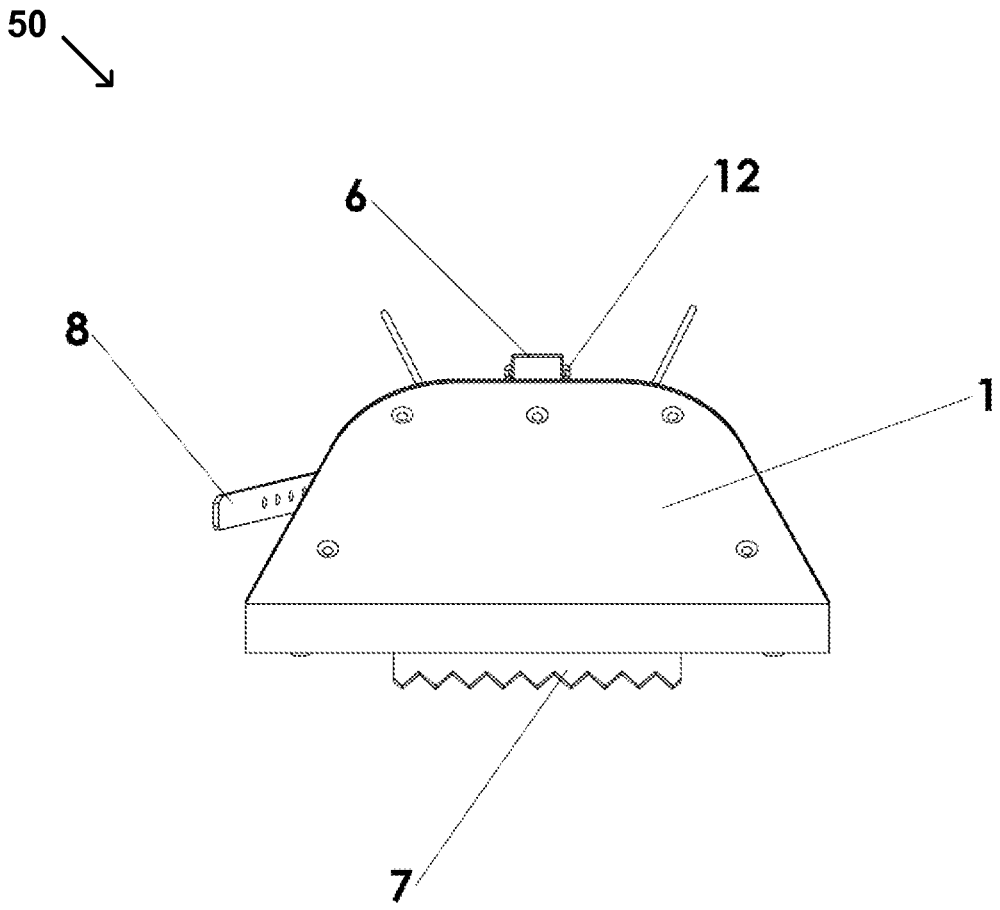
FIG. 5 is a front-view drawing illustrating an exemplary collapsible snowshoe.
Figure 6:
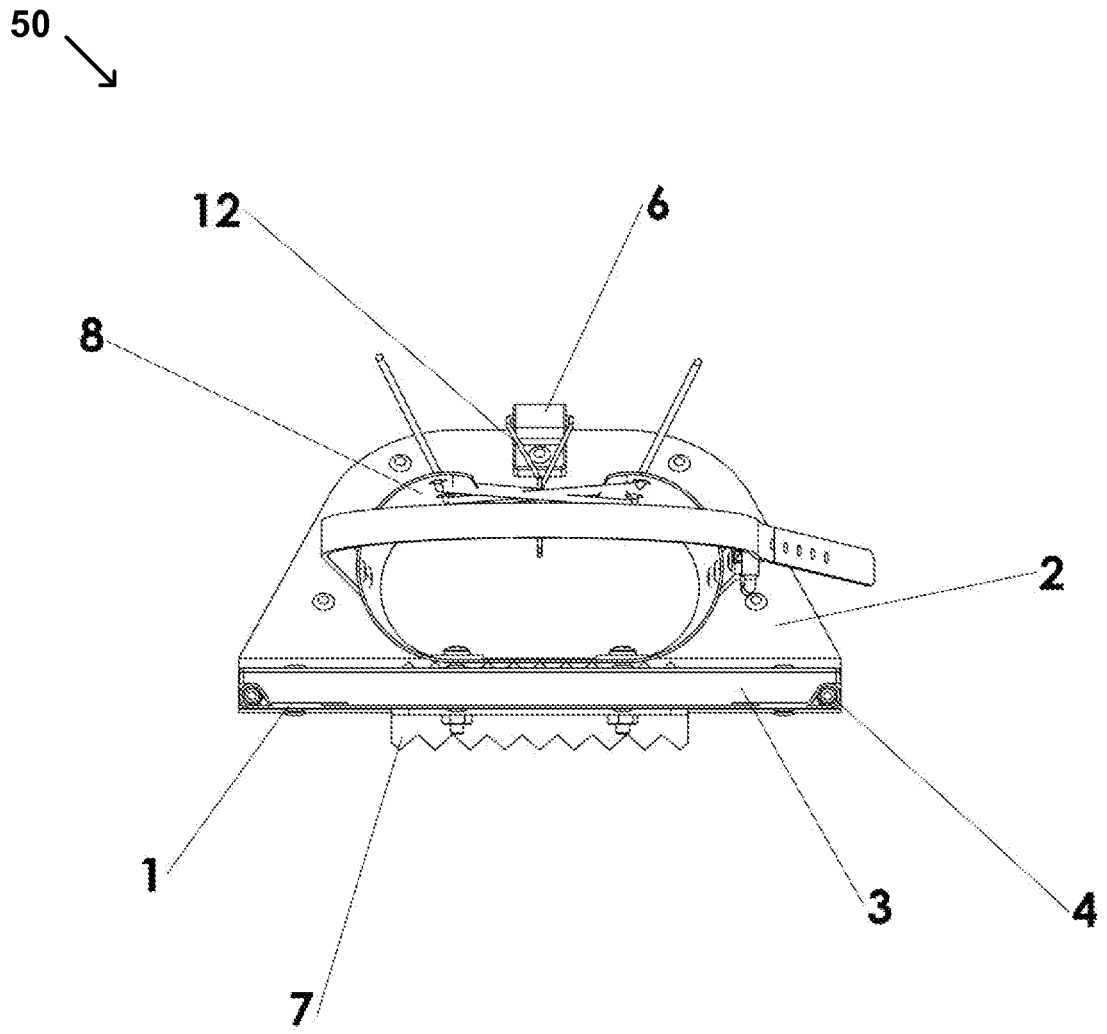
FIG. 6 is a rear-view drawing illustrating an exemplary collapsible snowshoe.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a snowshoe having both a compact stored configuration and a usable configuration. When in its compact stored configuration, the snowshoe is particularly adapted for storage until a situation arises requiring the use of the snowshoes.

The collapsible snowshoe can be stored in a small space, and be used for emergencies, for example, by car drivers stranded during a winter storm, snow machine riders with a mechanical failure, adventurers, armed forces, or any outdoor enthusiast. The collapsible snowshoe is easy to manufacture, cost effective, and reliable.

In order to provide the greatest benefit to the user, embodiments of the invention utilize light weight and high strength materials. Use of high strength and lightweight materials provides a rigid and strong snowshoe and one which can be used for long distance travel while minimizing the user's fatigue. Moreover, the materials for the snowshoe frame, as well as other components of the snowshoe, are selected so that the volume occupied by the snowshoe when in its stored configuration is minimized.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

The following explanations of certain terms are meant to be illustrative rather than exhaustive. These terms have their ordinary meanings given by usage in the art and in addition include the following explanations.

As used herein, the term "about" refers to a variation of 10 percent of the value specified; for example about 50 percent carries a variation from 45 to 55 percent.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

FIGS. 1-6 are various view drawings illustrating an exemplary collapsible snowshoe 50. The exemplary collapsible snowshoe 50 includes a deck 1, a guard member 2, cross members 3, removable longitudinal support members 4, retainers 5, a connector member 6, a crampon 7, a snowshoe binding 8, a lanyard 12, and a lanyard retainer 13.

The deck 1 includes a front section 23 and a rear section 24. The front section 23 of deck 1 is attached to the guard member 2. The rear section 24 of deck 1 includes a first longitudinal sleeve 25 and a second longitudinal sleeve 26 for receiving the two removable longitudinal support members 4. The first longitudinal sleeve 25 and the second longitudinal sleeve 26 are substantially parallel to each other and are substantially perpendicular to the cross members 3. In this embodiment, the first longitudinal sleeve 25 and the second longitudinal sleeve 26 are prepared by riveting.

In this embodiment, the collapsible snowshoe 50 is rectangular in shape with the deck 1 having a rectangular shape with each longitudinal edge substantially parallel to each other and the cross members 3 having the same length. In other embodiments, the collapsible snowshoe 50 is non-rectangular in shape with the deck 1 having a non-rectangular shape with each longitudinal edge not parallel to each other and the cross members 3 not having the same length.

The cross members 3 are also attached to the deck 1 by rivets. The two retainers 5 are fittings that are independently that may be permanently secured to each of the removable longitudinal support members 4 by, for example, glue. In this embodiment, the retainers 5 and their corresponding removable longitudinal support members 4 are not connected to each other. In another embodiment, the retainers 5 may be connected to each other by the cord to prevent loss of each removable longitudinal support member 4.

In another embodiment, a single removable longitudinal support member 4 that is shaped appropriately (e.g., U-shaped) to insert into both the first longitudinal sleeve 25 and the second longitudinal sleeve 26 may be also used. In this embodiment, the first longitudinal sleeve 25 and the second longitudinal sleeve 26 are both continuous sleeves. In another embodiment, the first longitudinal sleeve 25 and the second longitudinal sleeve 26 are not continuous sleeves. In yet another embodiment, a series of loops or similar longitudinal support member-catching devices spaced along each longitudinal edge may be used to contain the removable longitudinal support members 4.

In this embodiment, there are four cross members 3. However, various other embodiments may contain from about two cross members 3 to about one hundred cross members 3. In this embodiment, the snowshoe binding 8 is attached transversely to one cross member 3 and the front of the snowshoe binding 8 is oriented toward the guard member 2. The connector 27 includes a connector member 6, a lanyard 12, and a lanyard retainer 13.

During use, the collapsible snowshoe 50 is unrolled; the removable longitudinal support members 4 are independently inserted into the front of the first longitudinal sleeve 25 and the front of the second longitudinal sleeve 26 until the retainers 5 independently contact the first longitudinal sleeve 25 and the second longitudinal sleeve 26, respectively. The inserted removable longitudinal support members 4 provide rigidity to the deck 1 of the collapsible snowshoe 50. In this embodiment, there are two removable longitudinal support members 4. However, various other embodiments many contain from about three removable longitudinal support members 4 to about one hundred removable longitudinal support members 4 inserted into a corresponding number of longitudinal sleeves.

After the removable longitudinal support members 4 are secured, the tension on the connector 27 is adjusted by moving the lanyard retainer 13 along the lanyard 12. If the lanyard retainer 13 is moved along the lanyard 12 toward the guard member 2, the angle of the guard member 2 is increased. If the lanyard retainer 13 is moved along the lanyard 12 away from the guard member 2, the angle of the guard member 2 is decreased. In this manner, the angle of the guard member 2 relative to the deck 1 is adjusted. As a result, the angled guard member 2 prevents each removable longitudinal support member 4 from moving forward from and out of the first longitudinal sleeve 25 and the second longitudinal sleeve 26, respectively.

Figure 7:
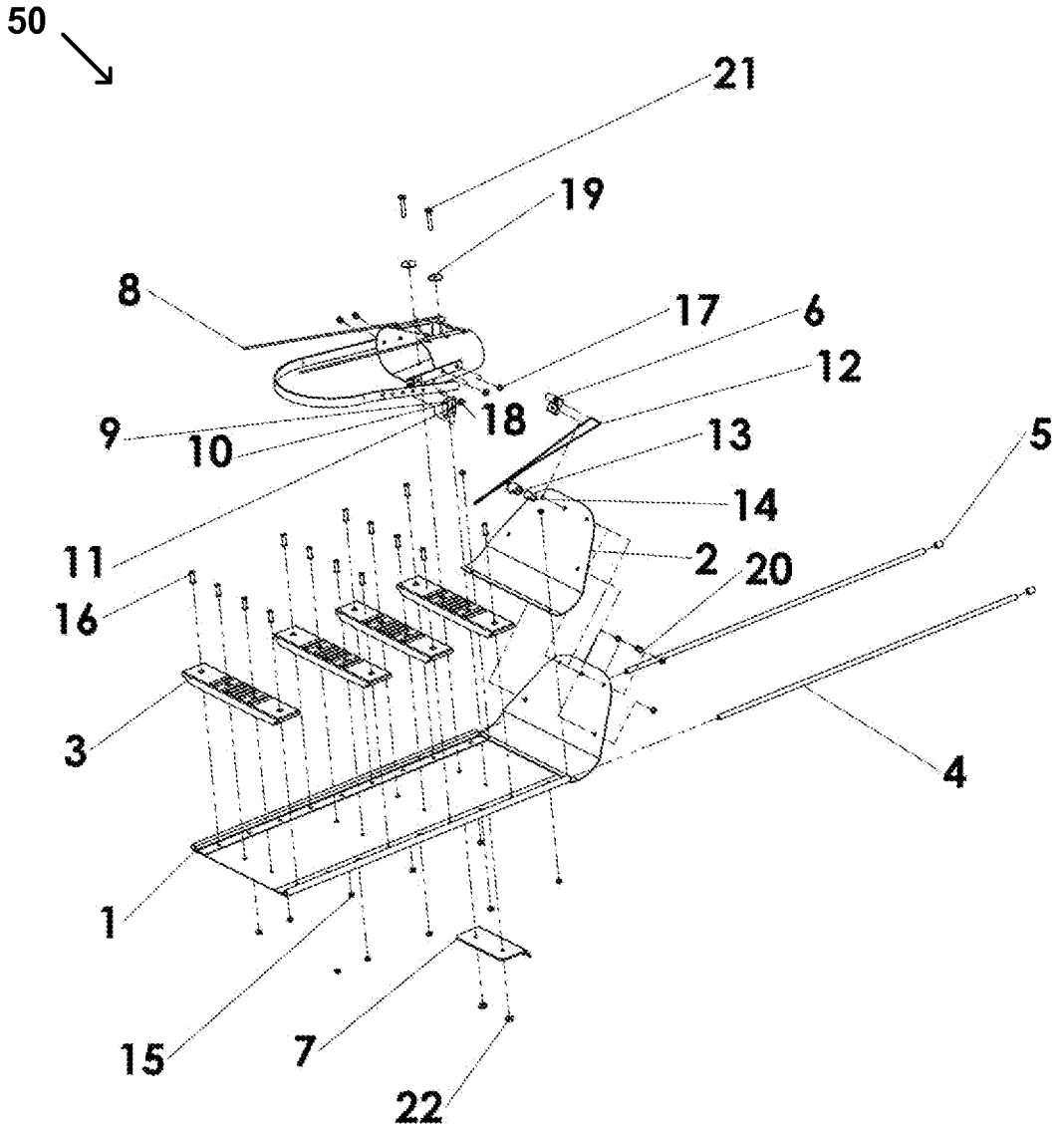
FIG. 7 is a perspective exploded side-view drawing illustrating an exemplary collapsible snowshoe.

FIG. 7 is a perspective exploded side-view drawing illustrating an exemplary collapsible snowshoe 50. The exemplary collapsible snowshoe 50 includes a deck 1, a guard member 2, cross members 3, removable longitudinal support members 4, retainers 5, a connector 6, a crampon 7, a snowshoe binding 8, a buckle 9, a buckle roller 10, a buckle pin 11, a lanyard 12, a lanyard retainer 13 and 14, deck rivets 15, cross bar rivets 16, binding strap rivets 17, a buckle rivet 18, binding washers 19, a connector rivet 20, binding screws 21, and binding screw nuts 22.

The deck 1 may be made of one or more flexible materials, one or more rigid material connected together, for example, by hinges, or a combination of one or more flexible materials and one or more rigid materials.

The deck 1 may be made of one or more flexible materials. The one or more flexible materials may include, for example, neoprene, nylon, animal hide, Kevlar, polyester, polyethylene, silk, cotton, polypropylene, metal, and the like, or a combination thereof. In one embodiment, the deck 1 may include one or more rigid materials. The one or more rigid materials may include, for example, aluminum, titanium, stainless steel, fiberglass, fiber, wood, steel, magnesium, carbon-fiber, magnesium-lithium alloy, plastic, and the like, or a combination thereof.

In one embodiment, the deck 1 may include a urethane coated nylon canvas. In another embodiment, the deck 1 may include a thermoset chlorinated polyethylene. Both longitudinal edges of the deck 1 may be folded to create sleeves and are fastened by welding, soldering, gluing, stapling, sewing, riveting, buttoning, and the like, or a combination thereof.

The guard member 2 may be made of, for example, aluminum, titanium, stainless steel, fiberglass, fiber, wood, steel, magnesium, carbon-fiber, magnesium-lithium alloy, plastic, or a combination thereof. In one embodiment, the guard member 2 is made of a linear polyethylene or similar suitable type of material. In this embodiment, the guard member 2 is mounted on the top face of the deck 1 using deck rivets 15. In other embodiments, the guard member 2 is mounted on the top face of the deck 1 by welding, soldering, gluing, stapling, sewing, buttoning, and the like, or a combination thereof.

The cross members 3 may be made of for example, aluminum, titanium, stainless steel, fiberglass, fiber, wood, steel, magnesium, carbon-fiber, magnesium-lithium alloy, plastic, or a combination thereof. In one embodiment, the cross members 3 are made of wood or a synthetic polymer material and are fastened to the top face of the deck 1 with crossbar rivets 16. In other embodiments, the cross members 3 are mounted on the top face of the deck 1 by welding, soldering, gluing, stapling, sewing, buttoning, and the like, or a combination thereof.

The snowshoe binding 8 may be, for example, a traditional snowshoe binding, commercially available snowshoe binding, a home-made snowshoe binding, or a proprietary snowshoe binding. The snowshoe binding 8 may be made of, for example, a urethane coated nylon canvas, a thermoset chlorinated polyethylene, or the like. The snowshoe binding 8 assembly is mounted to the top face of the first cross member 3 with flat head machine binding screws 21 and fender binding washers 19. The snowshoe binding 8 straps are attached to the snowshoe binding 8 with binding strap rivets 17. The buckle 9, buckle roller 10, and buckle pin 11 are attached to the snowshoe binding 8 strap with buckle rivets 18.

In other embodiments, the snowshoe binding 8 may be mounted on the first cross member 3 such that it can rotate on a pivot mounted on the first cross member 3.

The crampon 7 may be, for example, a traditional crampon, a commercially available crampon, or a proprietary crampon made of heat-treated aluminum, steel, or other suitable hard material. The crampon 7 may be, for example, mounted on the lower face of the deck 1 underneath the snowshoe binding 8 with binding screws 21 and binding screw nuts 22.

In other embodiments, additional secondary crampons (not shown) may also be mounted transversely on the lower face of the deck 1, longitudinally along the lateral edges of the lower face of deck 1, or a combination thereof.

In other embodiments, a heel lift (not shown) may be mounted on one of the rear cross members 3 to allow the user to ascend steep inclines without stressing the user's leg muscles.

The removable longitudinal support members 4 may be made of for example, aluminum, titanium, stainless steel, fiberglass, fiber, wood, steel, magnesium, carbon-fiber, magnesium-lithium alloy, plastic, or a combination thereof. The cross section of the removable longitudinal support members 4 will be adjusted depending on the material used. The removable longitudinal support members 4 are inserted in the longitudinal channels of the deck 1 during the assembly process prior usage. This is the only step required to assemble the collapsible snowshoe 50. The removable longitudinal support members 4 may be a single piece or a two-piece, tent pole type, connected with an elastic cord.

The retainers 5 may be made of, for example, metal, wood, or a synthetic polymer tube or cap permanently mounted on the removable longitudinal support members 4, pressed fit or glued. In other embodiments, the retainers 5 may be any objects that extend from the removable longitudinal support members 4 and prevent the removable longitudinal support members 4 from moving completely through each sleeve. The connector 6 may be made of, for example, a synthetic polymer mounted on the top face of the guard member 2 with connector rivet 20. The lanyard 12 may be made of, for example, multiple strands nylon passing through the connector 6 and the front loop of the snowshoe binding 8 laces.

Figure 8:
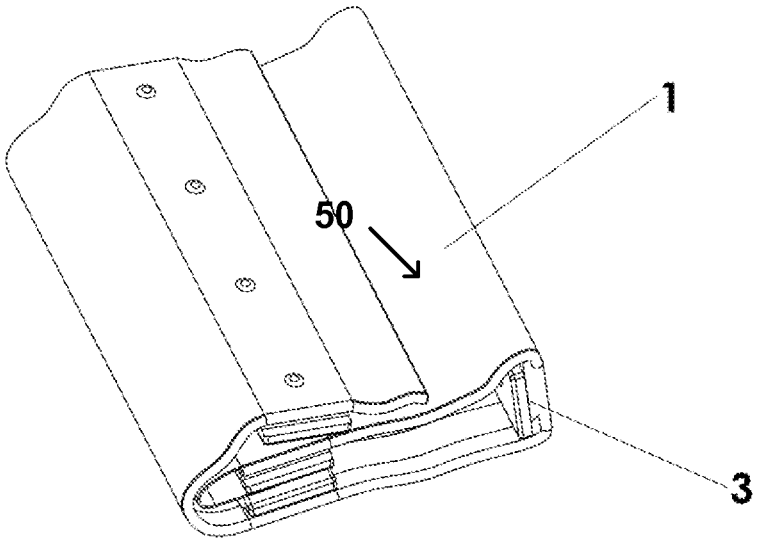
FIG. 8 is a perspective side-view drawing illustrating an exemplary collapsible snowshoe.
Figure 9:
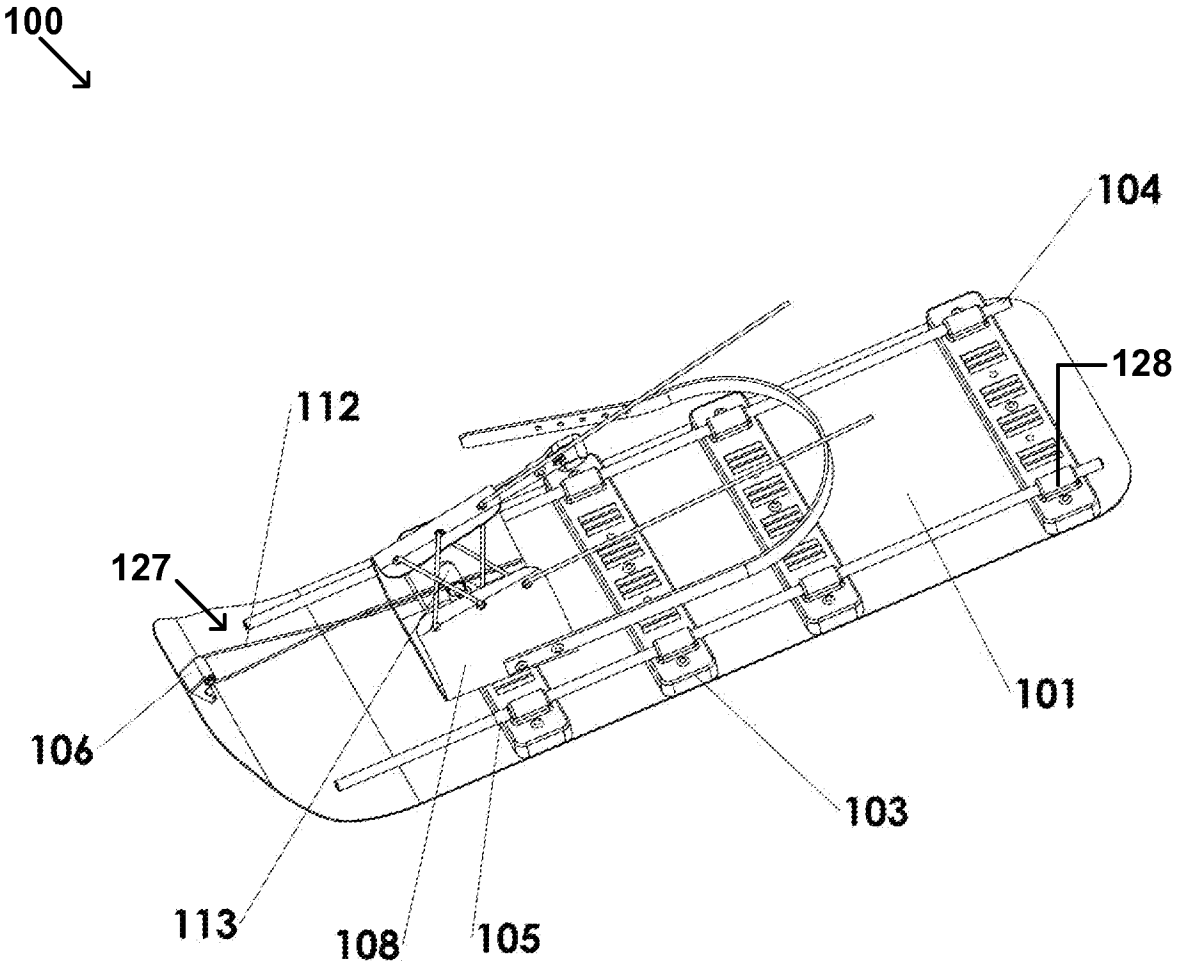
FIG. 9 is a perspective side-view drawing illustrating an exemplary collapsible snowshoe.
Figure 10:
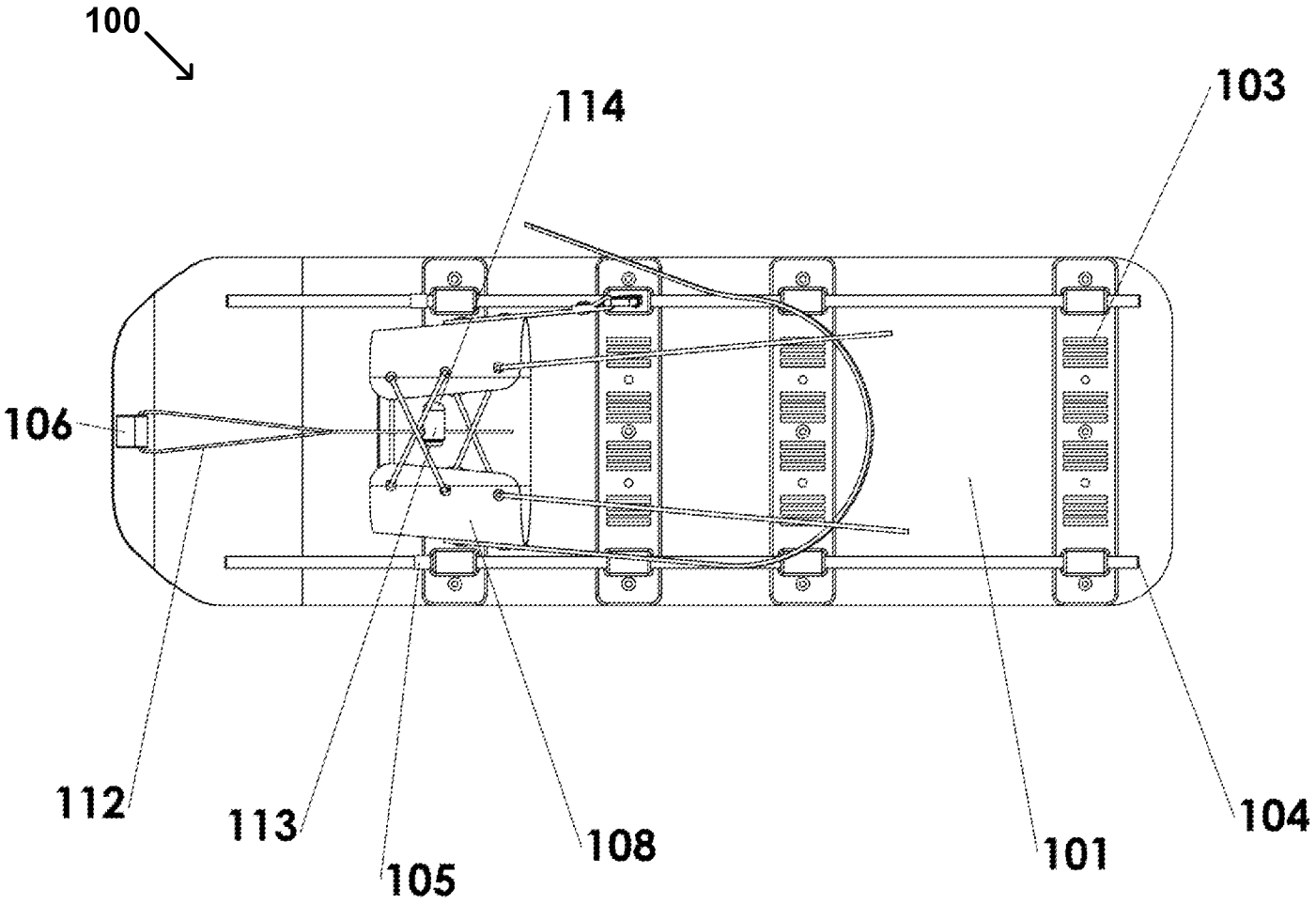
FIG. 10 is a top-view drawing illustrating an exemplary collapsible snowshoe.
Figure 11:
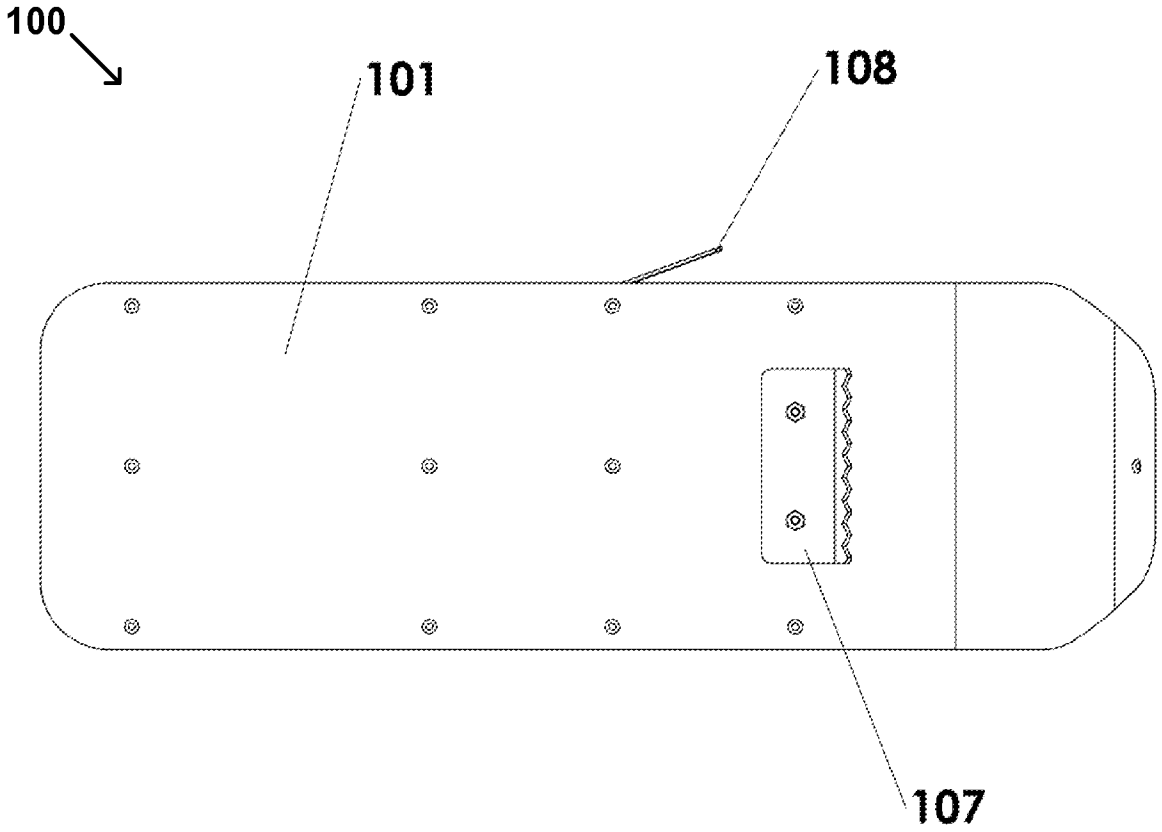
FIG. 11 is a bottom-view drawing illustrating an exemplary collapsible snowshoe.
Figure 12:
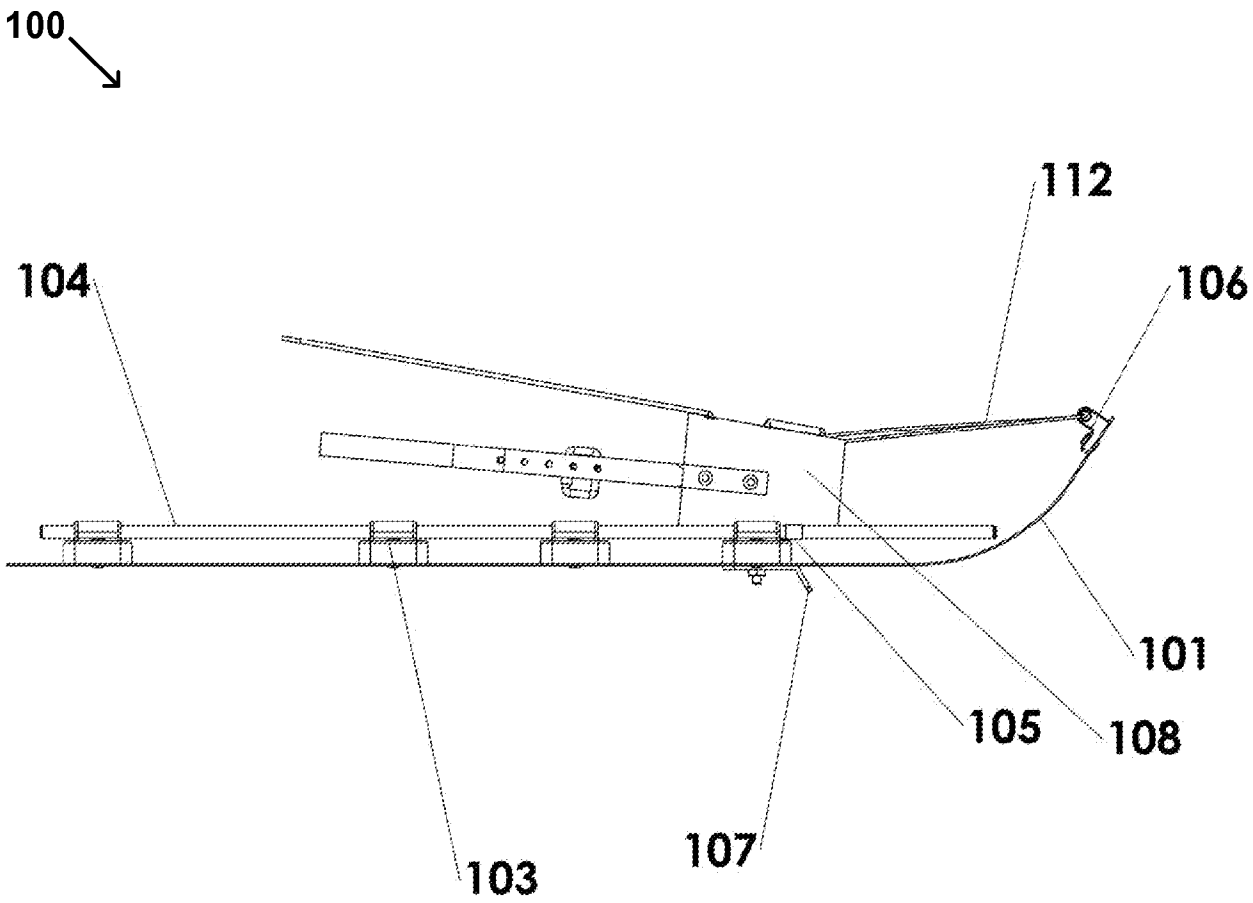
FIG. 12 is a side-view drawing illustrating an exemplary collapsible snowshoe.
Figure 13:
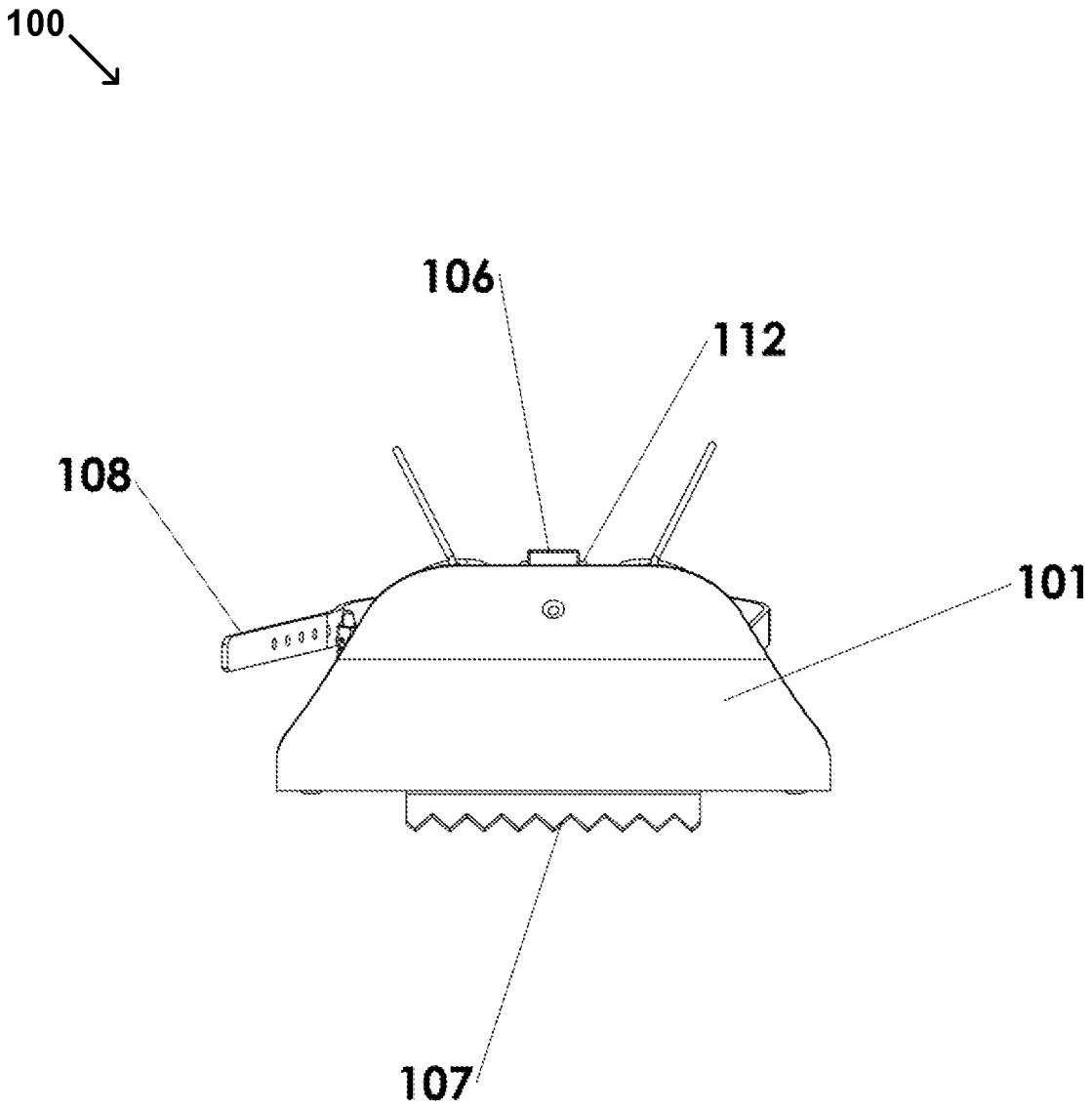
FIG. 13 is a front-view drawing illustrating an exemplary collapsible snowshoe.
Figure 14:
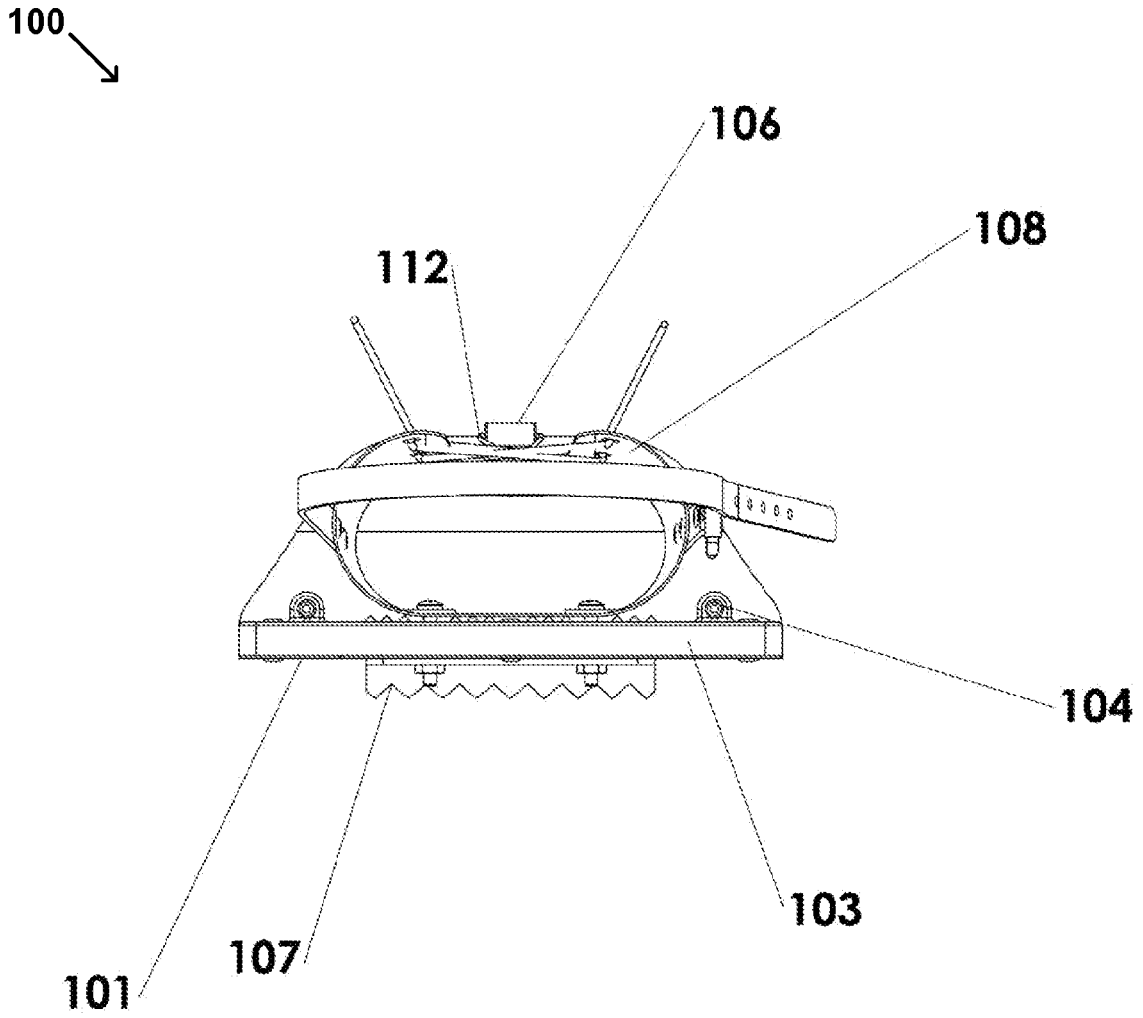
FIG. 14 is a rear-view drawing illustrating an exemplary collapsible snowshoe.

FIG. 8 is a perspective side-view drawing illustrating an exemplary collapsible snowshoe 50. The exemplary collapsible snowshoe 50 is rolled up and ready for storage.

FIGS. 9-14 are various view drawings illustrating an exemplary collapsible snowshoe 100. The exemplary collapsible snowshoe 100 includes a deck 101, cross members 103, removable longitudinal support members 104, retainers 105, a connector member 106, a crampon 107, a snowshoe binding 108, a lanyard 112, and a lanyard retainer 113.

In this embodiment, the collapsible snowshoe 100 is rectangular in shape with the deck 101 having a rectangular shape with each longitudinal edge substantially parallel to each other and the cross members 103 having the same length. In other embodiments, the collapsible snowshoe 100 is non-rectangular in shape with the deck 101 having a non-rectangular shape with each longitudinal edge not parallel to each other and the cross members 103 not having the same length. In contrast to the collapsible snowshoe 50 described herein above, which has both a deck 1 and a guard member 2, the deck 101 serves both deck and guard functions in the collapsible snowshoe 100. In another embodiment, the collapsible snowshoe 100 may have both a deck and a guard member.

The cross members 103 are attached to the deck 101 by rivets. The two retainers 105 are fittings that are independently that may be permanently secured to each of the removable longitudinal support members 104 by, for example, glue. In this embodiment, the retainers 105 and their corresponding removable longitudinal support members 104 are not connected to each other. In another embodiment, the retainers 105 may be connected to each other by the cord to prevent loss of each removable longitudinal support member 104.

In this embodiment, there are four cross members 103. However, various other embodiments many contain from about two cross members 103 to about one hundred cross members 103. In this embodiment, the snowshoe binding 108 is attached transversely to one cross member 103 and the front of the snowshoe binding 108 is oriented toward the front of deck 101. The connector 127 includes a connector member 106, a lanyard 112, and a lanyard retainer 113.

During use, the collapsible snowshoe 100 is unrolled, the removable longitudinal support members 104 are independently inserted through the fittings 128 on the cross members 103 until contact with the fittings 128 on the forward most cross members 103 is made with the retainers 105 on each the removable longitudinal support members 104. The inserted removable longitudinal support members 104 provide rigidity to the deck 101 of the collapsible snowshoe 100. In this embodiment, there are two removable longitudinal support members 104. However, various other embodiments may contain from about three removable longitudinal support members 104 to about one hundred removable longitudinal support members 104 inserted into a corresponding number of fittings 128 on the cross members 103.

After the removable longitudinal support members 104 are secured, the tension on the connector 127 is adjusted by moving the lanyard retainer 113 along the lanyard 112. If the lanyard retainer 113 is moved along the lanyard 112 toward the front of the deck 101, the angle of the front of the deck 101 is increased. If the lanyard retainer 113 is moved along the lanyard 112 away from the front of the deck 101, the angle of the front of the deck 101 is decreased. In this manner, the angle of the front of the deck 101 is adjusted. As a result, the angled front of the deck 101 prevents each removable longitudinal support member 104 from moving forward from and out of the fittings 128 on the cross members 103.

In another embodiment, a single removable longitudinal support member 104 that is shaped appropriately (e.g., U-shaped) to insert into fittings 128 on the cross members 103 may be also used. In this embodiment, the fittings 128 on the cross members 103 are tube. In another embodiment, the fittings 128 on the cross members 103 are not tubes. In yet another embodiment, a series of loops or similar longitudinal support member-catching fittings 128 on the cross members 103 may be used to contain the removable longitudinal support members 104.

Figure 15:
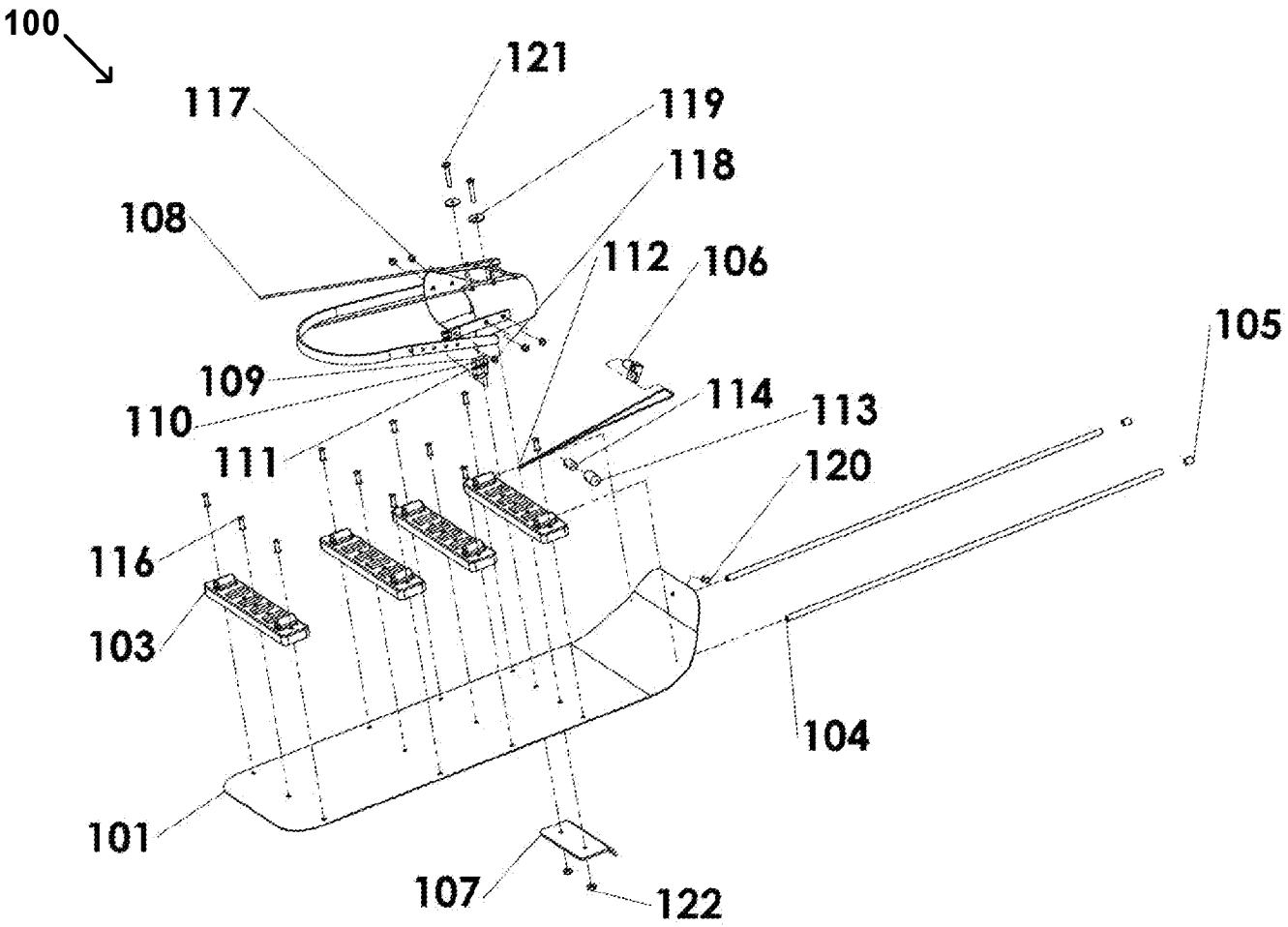
FIG. 15 is a perspective exploded side-view drawing illustrating an exemplary collapsible snowshoe.
Figure 16:
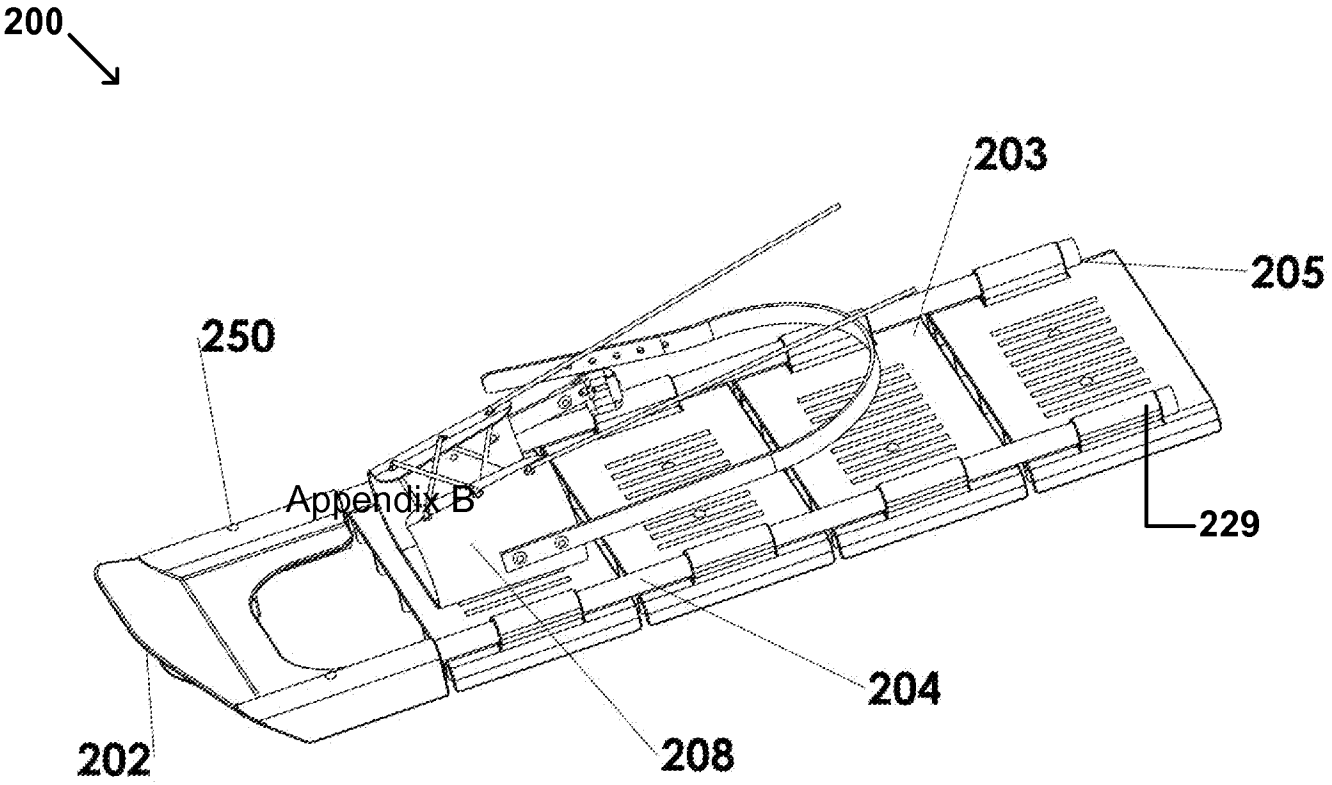
FIG. 16 is a perspective side-view drawing illustrating an exemplary collapsible snowshoe.
Figure 17:
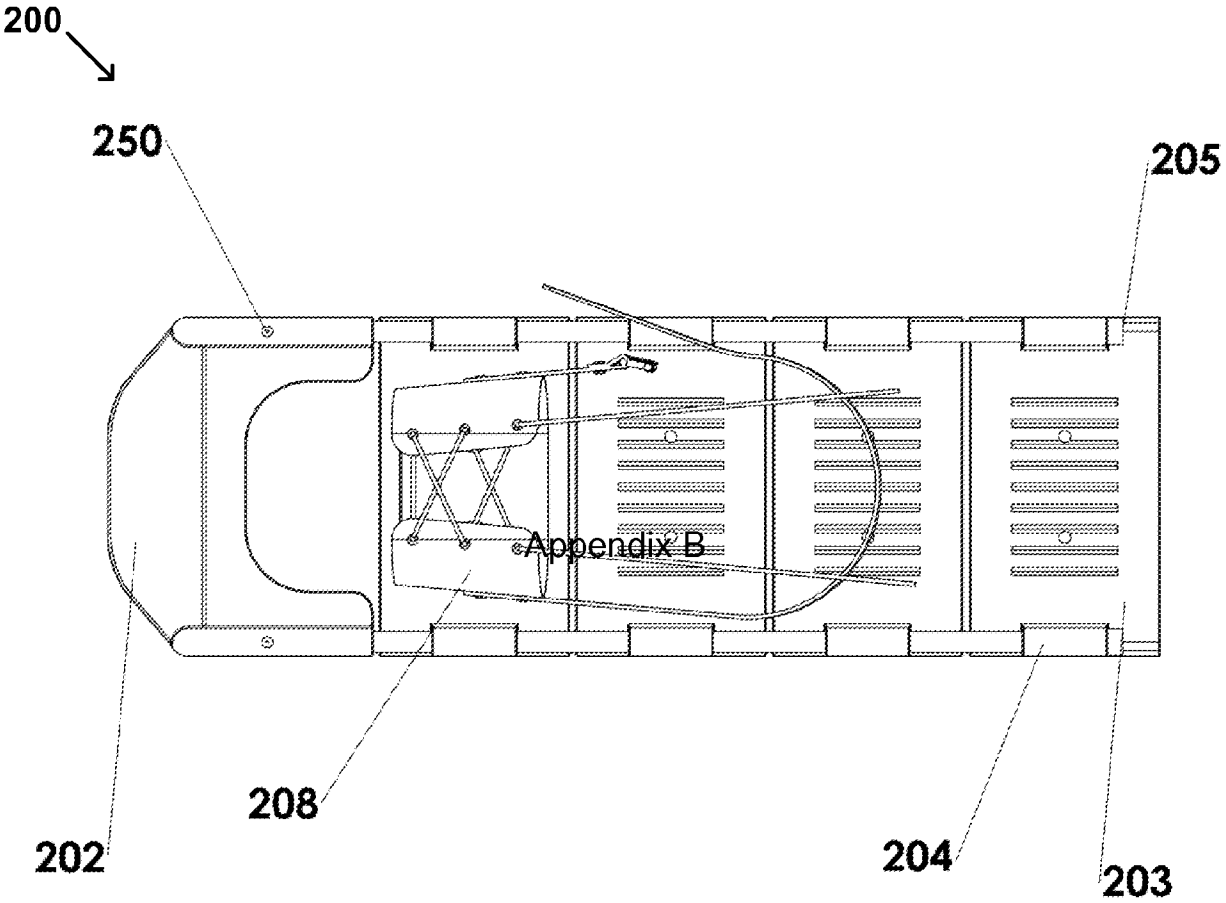
FIG. 17 is a top-view drawing illustrating an exemplary collapsible snowshoe.
Figure 18:
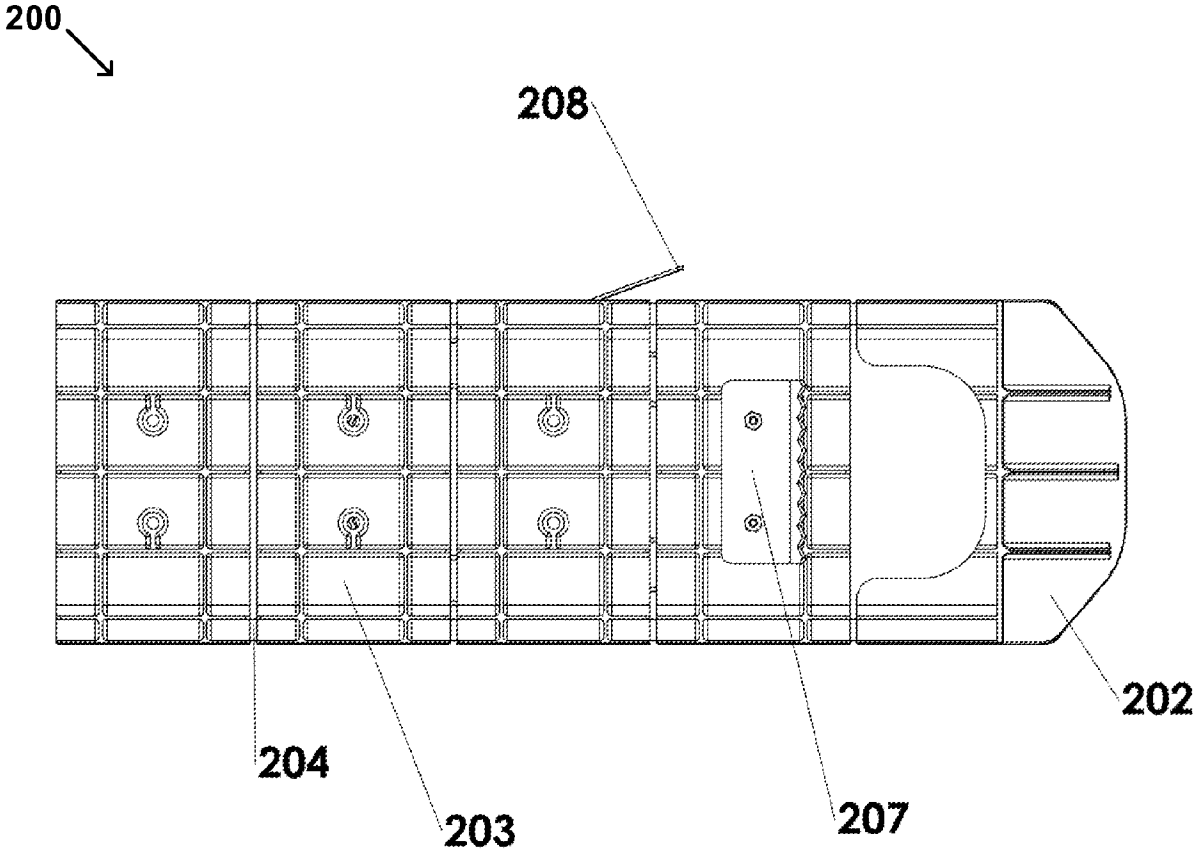
FIG. 18 is a bottom-view drawing illustrating an exemplary collapsible snowshoe.
Figure 19:
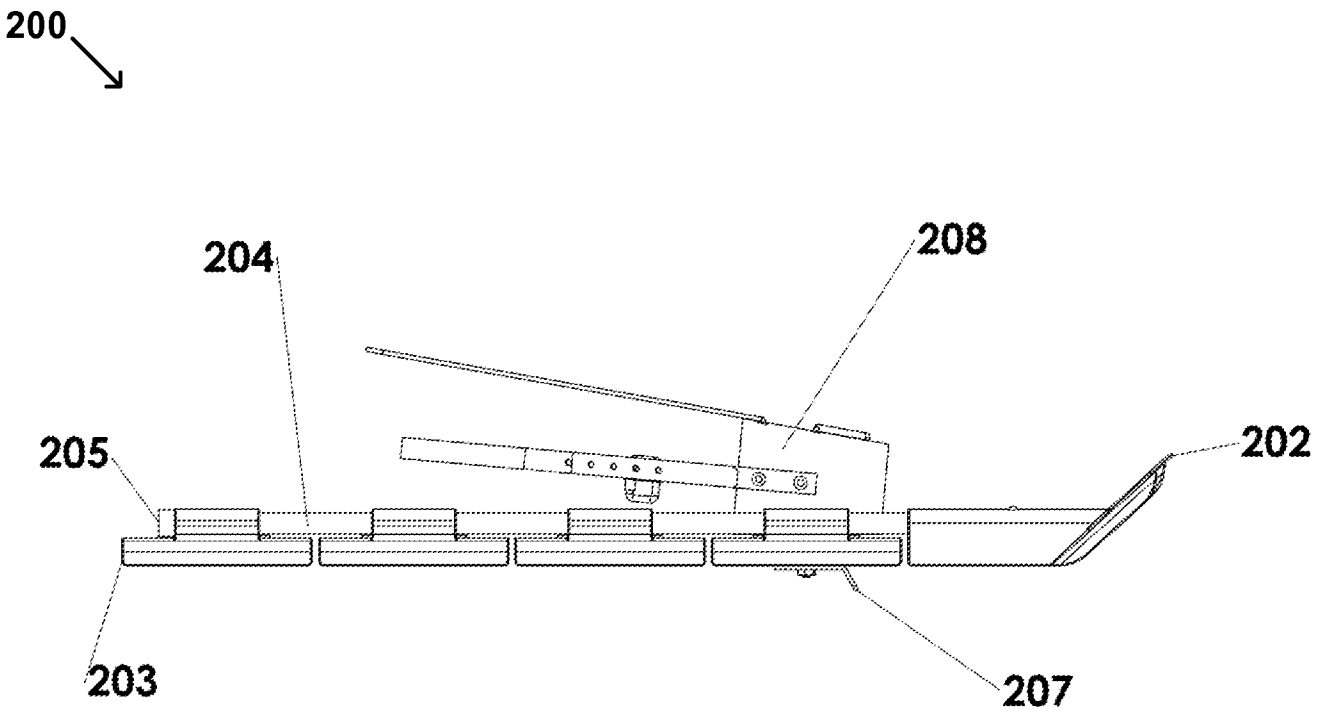
FIG. 19 is a side-view drawing illustrating an exemplary collapsible snowshoe.
Figure 20:
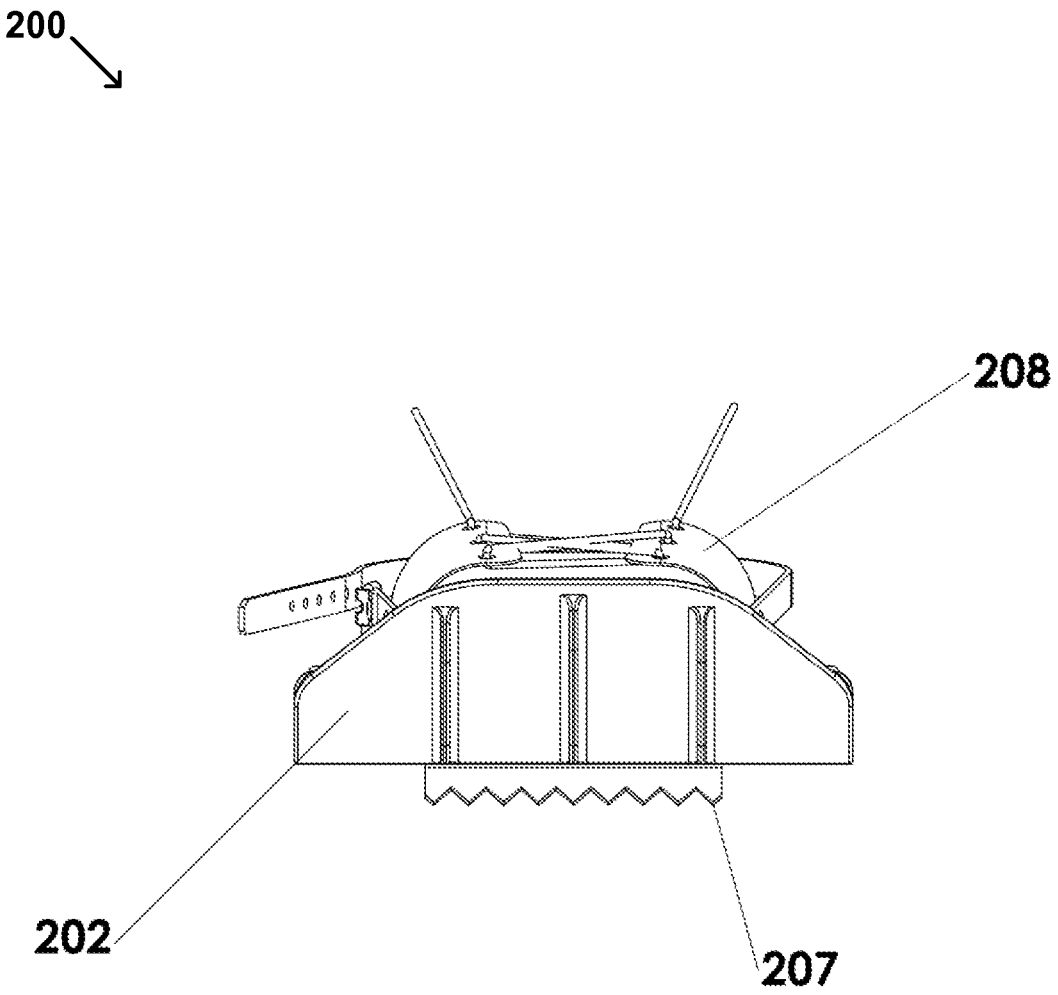
FIG. 20 is a front-view drawing illustrating an exemplary collapsible snowshoe.
Figure 21:
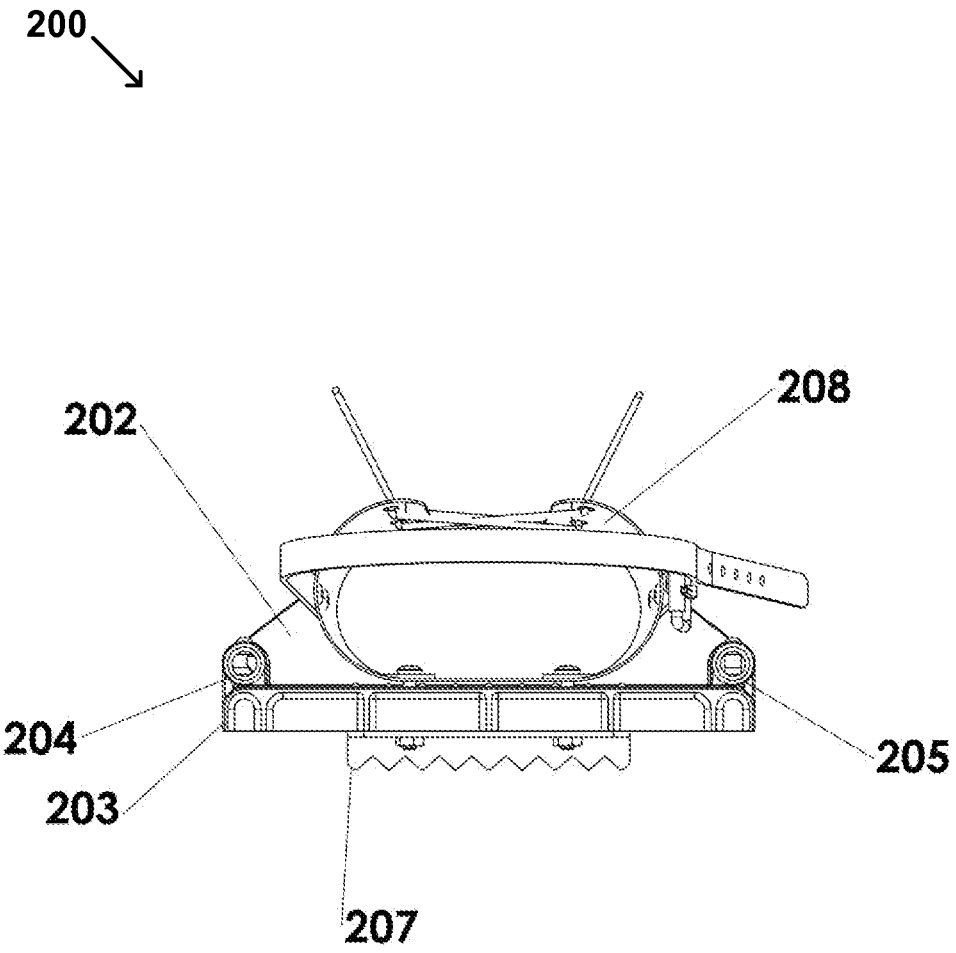
FIG. 21 is a rear-view drawing illustrating an exemplary collapsible snowshoe.

FIG. 15 is a perspective exploded side-view drawing illustrating an exemplary collapsible snowshoe 100. The exemplary collapsible snowshoe 100 includes a deck 101, cross members 103, removable longitudinal support members 104, retainers 105, a connector 106, a crampon 107, a snowshoe binding 108, a buckle 109, a buckle roller 110, a buckle pin 111, a lanyard 112, a lanyard retainer 113 and 114, cross bar rivets 116, binding strap rivets 117, a buckle rivet 118, binding washers 119, binding crews 121, and binding screw nuts 122.

The deck 101 may be made of one or more flexible materials, one or more rigid material connected together, for example, by hinges, or a combination of one or more flexible materials and one or more rigid materials.

The deck 101 may be made of one or more flexible materials. The one or more flexible materials may include, for example, neoprene, nylon, animal hide, Kevlar, polyester, polyethylene, silk, cotton, polypropylene, metal, and the like, or a combination thereof.

In one embodiment, the deck 101 may include one or more rigid materials. The one or more rigid materials may include, for example, aluminum, titanium, stainless steel, fiberglass, fiber, wood, steel, magnesium, carbon-fiber, magnesium-lithium alloy, plastic, and the like, or a combination thereof.

In one embodiment, the deck 101 may include a urethane coated nylon canvas.

The cross members 103 may be made of, for example, aluminum, titanium, stainless steel, fiberglass, fiber, wood, steel, magnesium, carbon-fiber, magnesium-lithium alloy, plastic, or a combination thereof. In one embodiment, the cross members 103 are made of wood or a synthetic polymer material and are fastened to the top face of the deck 101 with crossbar rivets 116. In other embodiments, the cross members 103 are mounted on the top face of the deck 101 by welding, soldering, gluing, stapling, sewing, buttoning, and the like, or a combination thereof.

The snowshoe binding 108 may be, for example, a traditional snowshoe binding, a commercially available snowshoe binding, a home-made snowshoe binding, or a proprietary snowshoe binding. The snowshoe binding 108 may be made of, for example, a urethane coated nylon canvas, a thermoset chlorinated polyethylene, or the like. The snowshoe binding 108 assembly is mounted to the top face of the first cross member 103 with flat head machine binding screws 121 and fender binding washers 119. The snowshoe binding 108 straps are attached to the snowshoe binding 108 with binding strap rivets 117. The buckle 109, buckle roller 110, and buckle pin 111 are attached to the snowshoe binding 108 strap with buckle rivets 118.

In other embodiments, the snowshoe binding 108 may be mounted on the first cross member 103 such that it can rotate on a pivot mounted on the first cross member 103.

The crampon 107 may be, for example, a traditional crampon, a commercially available crampon, or a proprietary crampon made of heat-treated aluminum, steel, or other suitable hard material. The crampon 107 may be, for example, mounted on the lower face of the deck 101 underneath the snowshoe binding 108 with binding screws 121 and binding screw nuts 122.

In other embodiments, additional secondary crat pons (not shown) may also be mounted transversely on the lower face of the deck 101, longitudinally along the lateral edges of the lower face of deck 101, or a combination thereof.

In other embodiments, a heel lift (not shown) may be mounted on one of the rear cross members 103 to allow the user to ascend steep inclines without stressing the user's leg muscles.

The removable longitudinal support members 104 may be made of, for example, aluminum, titanium, stainless steel, fiberglass, fiber, wood, steel, magnesium, carbon-fiber, magnesium-lithium alloy, plastic, or a combination thereof. The cross section of the removable longitudinal support members 104 will be adjusted depending on the material used. The removable longitudinal support members 104 are inserted in fittings 128 on the cross members 103 during the assembly process prior usage. This is the only step required to assemble the collapsible snowshoe 100. The removable longitudinal support members 104 may be a single piece or a two-piece, tent pole type, connected with an elastic cord.

The retainers 105 may be made of, for example, metal, wood, or a synthetic polymer tube or cap permanently mounted on the removable longitudinal support members 104, pressed fit or glued. In other embodiments, the retainers 105 may be any objects that extend from the removable longitudinal support members 104 and prevent the removable longitudinal support members 104 from moving completely through fittings 128 on the cross members 103. The connector 106 may be made of for example, a synthetic polymer mounted on the front of the deck 101 with rivet 120. The lanyard 112 may be made of, for example, multiple strands nylon passing through the connector 106 and the front loop of the snowshoe binding 108 laces.

FIGS. 16-21 are various view drawings illustrating an exemplary collapsible snowshoe 200. The exemplary collapsible snowshoe 200 includes a guard member 202, cross members 203, removable longitudinal support members 204, retainers 205, a crampon 207, a snowshoe binding 208, and a spring button 250.

In this embodiment, the collapsible snowshoe 200 is rectangular in shape with each longitudinal edge substantially parallel to each other and the cross members 203 having the same length. In other embodiments, the collapsible snowshoe 200 is non-rectangular in shape with each longitudinal edge not parallel to each other and the cross members 203 not having the same length. In contrast to the collapsible snowshoes 50 and 100 described herein above, which have both a decks 1 and 101, respectively, the guard member 202 and the cross members 203 serve both guard and deck functions in the collapsible snowshoe 200.

In this embodiment, there are four cross members 203. However, various other embodiments may contain from about two cross members 203 to about one hundred cross members 203. In this embodiment, the snowshoe binding 208 is attached transversely to one cross member 203 and the front of the snowshoe binding 208 is oriented toward the front of the guard member 202. In one embodiment, the cross members 203 are connected to each other with, for example, hinges. In another embodiment, the cross members 203 are not connected to each other.

During use, the collapsible snowshoe 200 is unpacked, the removable longitudinal support members 204 are independently inserted through the fittings 229 on the cross members 203 until contact with the fittings 229 on the forward most cross member 203 is made with the retainers 205 on each the removable longitudinal support member 204. The inserted removable longitudinal support members 204 provide rigidity to the collapsible snowshoe 200.

After the removable longitudinal support members 204 are secured in the cross members 203, the front end of each of the removable longitudinal support members 204 are inserted into the guard member 202 such that the spring button 250 extends through the corresponding hole. The heads of each spring button 250 are positioned downward in line with the lower relief of the cross member 203 channels, as shown below in FIG. 23, so there is no need to depress the spring buttons 250 for each insertion.

Figure 22:
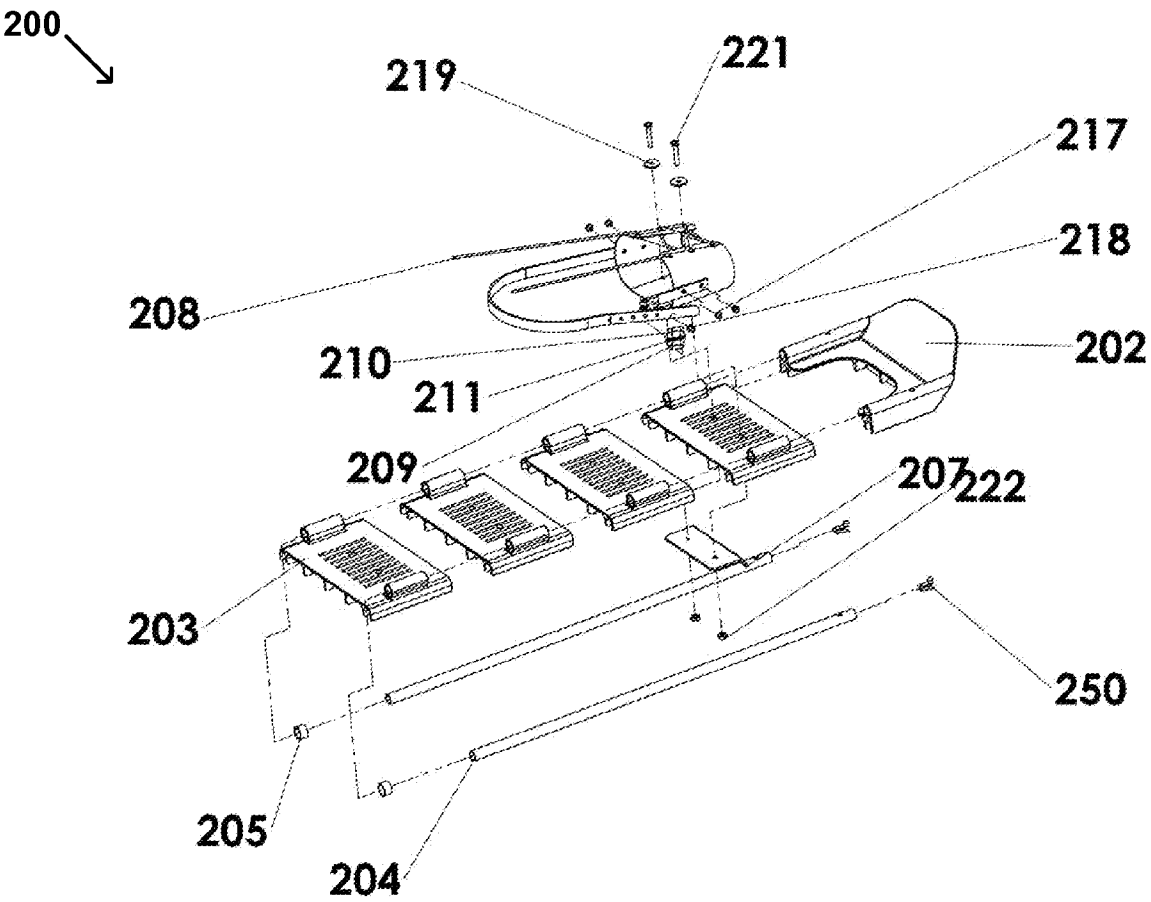
FIG. 22 is a perspective exploded side-view drawing illustrating an exemplary collapsible snowshoe.

FIG. 22 is a perspective exploded side-view drawing illustrating an exemplary collapsible snowshoe 200. The exemplary collapsible snowshoe 200 includes cross members 203, removable longitudinal support members 204, retainers 205, a crampon 207, a snowshoe binding 208, a buckle 209, a buckle roller 210, a buckle pin 211, binding strap rivets 217, a buckle rivet 218, binding washers 219, binding screws 221, binding screw nuts 222, and spring buttons 250.

The cross members 203 may be made of, for example, aluminum, titanium, stainless steel, fiberglass, fiber, wood, steel, magnesium, carbon-fiber, magnesium-lithium alloy, plastic, or a combination thereof.

The snowshoe binding 208 may be, for example, a traditional snowshoe binding, a commercially available snowshoe binding, a home-made snowshoe binding, or a proprietary snowshoe binding. The snowshoe binding 208 may be made of, for example, a urethane coated nylon canvas, a thermoset chlorinated polyethylene, or the like. The snowshoe binding 208 assembly is mounted to the top face of the first cross member 203 with flat head machine binding screws 221 and fender binding washers 219. The snowshoe binding 208 straps are attached to the snowshoe binding 208 with binding strap rivets 217. The buckle 209, buckle roller 210, and buckle pin 211 are attached to the snowshoe binding 208 strap with buckle rivets 218.

In other embodiments, the snowshoe binding 208 may be mounted on the first cross member 203 such that it can rotate on a pivot mounted on the first cross member 203.

The crampon 207 may be, for example, a traditional crampon, a commercially available crampon, or a proprietary crampon made of heat-treated aluminum, steel, or other suitable hard material. The crampon 207 may be, for example, transversely mounted on the lower face of the one of the cross members 203 underneath the snowshoe binding 208 with binding screws 221 and binding screw nuts 222.

In other embodiments, additional secondary crampons (not shown) may also be transversely mounted on the lower face of the middle and rear cross members 203, longitudinally along the lateral edges of the lower face of the cross members 203, or a combination thereof.

In other embodiments, the crampon 207 may be mounted a snowshoe binding 208 that is mounted on the first cross member 203 such that it can rotate on a pivot mounted on the first cross member 203.

In other embodiments, a heel lift (not shown) may be mounted on one of the rear cross members 203 to allow the user to ascend steep inclines without stressing the user's leg muscles.

The removable longitudinal support members 204 may be made of, for example, aluminum, titanium, stainless steel, fiberglass, fiber, wood, steel, magnesium, carbon-fiber, magnesium-lithium alloy, plastic, or a combination thereof. The cross section of the removable longitudinal support members 204 will be adjusted depending on the material used. The removable longitudinal support members 204 are inserted in fittings 229 on the cross members 203 during the assembly process prior usage. This is the only step required to assemble the collapsible snowshoe 200. The removable longitudinal support members 204 may be a single piece or a two-piece spring button or similar mechanical device.

The retainers 205 may be made of, for example, metal, wood, or a synthetic polymer tube or cap permanently mounted on the removable longitudinal support members 204, pressed fit or glued. In other embodiments, the retainers 205 may be any objects that extend from the removable longitudinal support members 204 and prevent the removable longitudinal support members 204 from moving completely through fittings 229 on the cross members 203.

Figure 23:
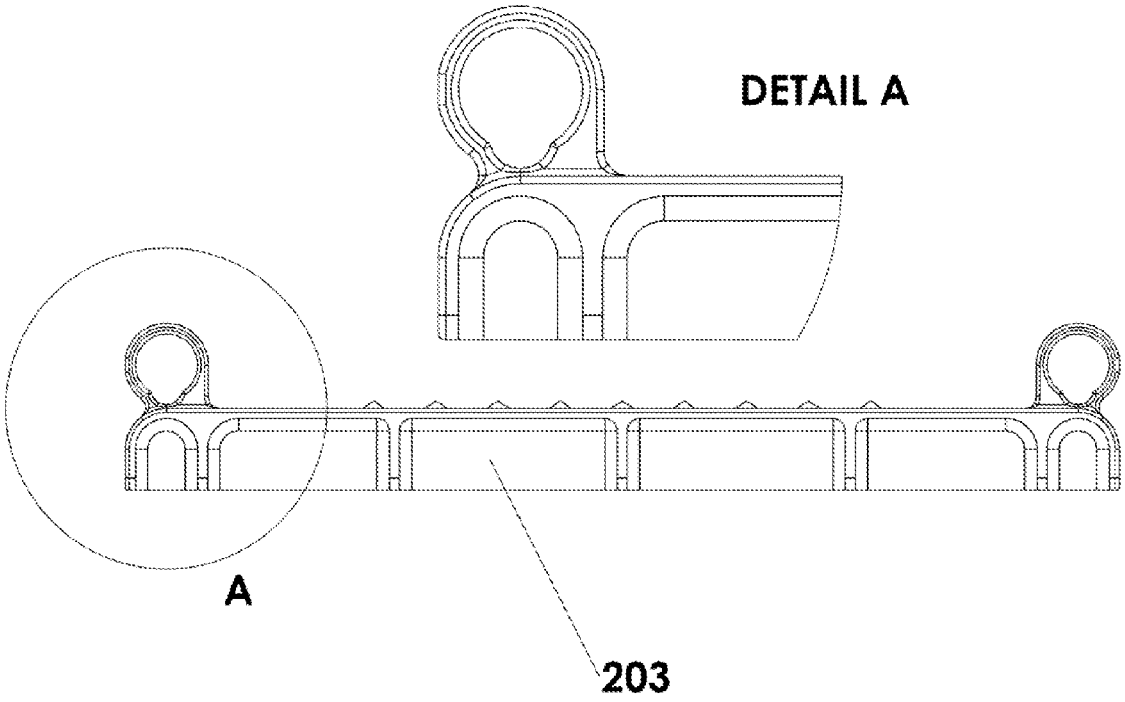
FIG. 23 is a side-view drawing illustrating an exemplary cross-member used in an exemplary collapsible snowshoe.

FIG. 23 is a side-view drawing illustrating an exemplary cross member 203. The exemplary cross member 203 includes a fitting 229 that accepts the spring button 250 on each removable longitudinal support member 204.

Figure 24:
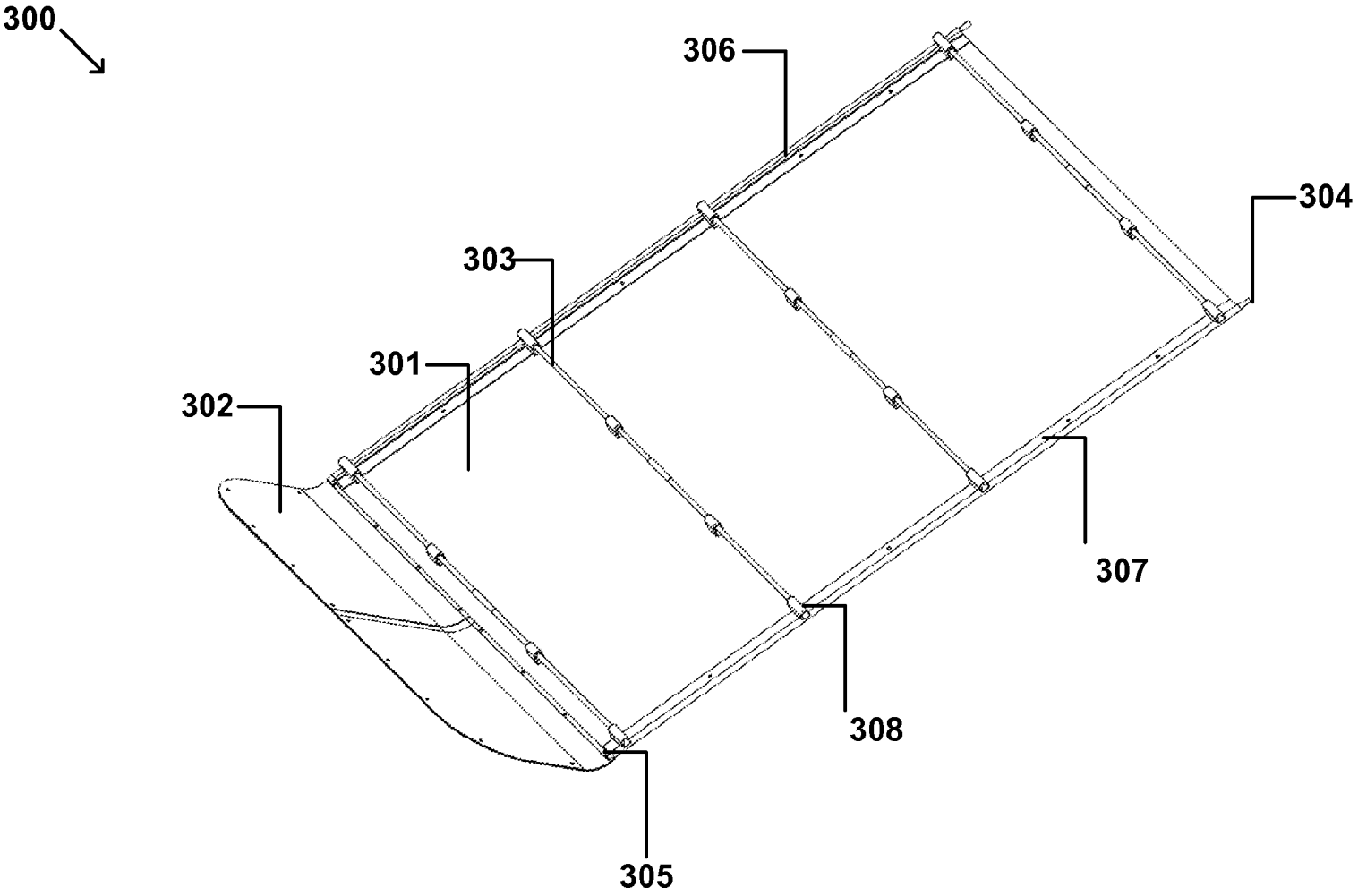
FIG. 24 is a perspective side-view drawing illustrating an exemplary collapsible sled.

FIG. 24 is a perspective side-view drawing illustrating an exemplary collapsible sled 300. The exemplary collapsible sled 300 includes a deck 301, a guard member 302, cross members 303, removable longitudinal support members 304, and retainers 305.

The front section of deck 301 is attached to the guard member 302. The rear section of deck 301 includes a first longitudinal sleeve 306 and a second longitudinal sleeve 307 for receiving the two removable longitudinal support members 304. The first longitudinal sleeve 306 and the second longitudinal sleeve 307 are substantially parallel to each other and are substantially perpendicular to the cross members 303. In this embodiment, the first longitudinal sleeve 306 and the second longitudinal sleeve 307 are prepared by riveting.

In this embodiment, the collapsible sled 300 is rectangular in shape with each longitudinal edge substantially parallel to each other and the cross members 303 having the same length. In other embodiments, the collapsible sled 300 is non-rectangular in shape with each longitudinal edge not parallel to each other and the cross members 303 not having the same length.

In this embodiment, there are four cross members 303. However, various other embodiments many contain from about two cross members 303 to about one hundred cross members 303.

During use, the collapsible sled 300 is unpacked, the removable longitudinal support members 304 are independently inserted through the fittings 308 on the cross members 303 until contact with the fittings 308 on the forward most cross member 303 is made with the retainers 305 on each the removable longitudinal support member 304. The inserted removable longitudinal support members 304 provide rigidity to the collapsible sled 300.

The cross members 303 may be made of, for example, aluminum, titanium, stainless steel, fiberglass, fiber, wood, steel, magnesium, carbon-fiber, magnesium-lithium alloy, plastic, or a combination thereof.

The removable longitudinal support members 304 may be made of, for example, aluminum, titanium, stainless steel, fiberglass, fiber, wood, steel, magnesium, carbon-fiber, magnesium-lithium alloy, plastic, or a combination thereof. The cross section of the removable longitudinal support members 304 will be adjusted depending on the material used. The removable longitudinal support members 304 are inserted in fittings 308 on the cross members 303 during the assembly process prior usage. This is the only step required to assemble the collapsible sled 300. The removable longitudinal support members 304 may be a single piece or a two-piece, tent pole type, connected with an elastic cord.

The retainers 305 may be made of, for example, metal, wood, or a synthetic polymer tube or cap permanently mounted on the removable longitudinal support members 304, pressed fit or glued. In other embodiments, the retainers 305 may be any objects that extend from the removable longitudinal support members 304 and prevent the removable longitudinal support members 304 from moving completely through fittings 308 on the cross members 303.

The collapsible snowshoes, as described herein, may be fabricated in a variety of lengths. The preferred ranges of lengths for the collapsible snowshoes is preferred to be in the range from about fourteen inches to about thirty-six inches, more preferably in the range from about eighteen inches to about thirty inches, and most preferably in the range from about twenty inches to about thirty inches. Also, the collapsible snowshoes illustrated in the figures can be fabricated in a variety of widths. The preferred ranges of widths for the collapsible snowshoes is preferred to be in the range from about six inches to about twelve inches, more preferably in the range from about seven inches to about eleven inches, and most preferably in the range from about eight inches to about ten inches. Depending upon the characteristics of the user, for example, height, weight, stride length and so forth, different combinations of lengths and widths for the collapsible snowshoe can be selected. Also, a user may desire larger snowshoes if stability and load carrying capacity are paramount considerations. If speed and agility are paramount considerations, a smaller snowshoe may be selected. Thus, the size of the collapsible snowshoe may be selected in accordance with the end use in mind.

The collapsible snowshoes, as described herein, may have a total surface area in the range of about 75 square inches to about 375 square inches. Depending on the weight (or otherwise any characteristic) of the user, the surface area may be in the range of about 75 to about 225 square inches for a smaller user. Alternatively, the surface area may be in the range of about 125-300 square inches for a medium size user. Yet alternatively, the surface area may be in the range of about 175-375 square inches for a larger user. In some embodiments, the total surface area may be about 150 square inches for a smaller user, about 190 square inches for a medium size user, and about 275 square inches for a larger user.

As may be understood by one skilled in the art, the above ranges and sizes may be adjusted based on particular characteristics of the user (e.g., weight, height, foot size, etc.). Additionally, the above sizes may be also adjusted based on the surface conditions for which the user intends to use the snowshoe.

The collapsible snowshoes, as described herein, may contain removable longitudinal support members manufactured from aluminum, stainless steel, titanium, plastic, wood, carbon fiber, magnesium, magnesium-lithium alloy, steel, fiber, or any other suitable material. The diameter of the removable longitudinal support members can be in the range of 8 millimeters (mm) to 40 mm. Alternatively, the diameter range can be 15 mm to 25 mm. Alternatively, the diameter of the removable longitudinal support members can be 19 mm.

As can be understood by one skilled in the art, the diameter of the removable longitudinal support members can vary from one longitudinal support member to the other. Further, within each specific portion of the removable longitudinal support member, the diameter of the removable longitudinal support member can vary as desired. In some embodiments, the removable longitudinal support members can have a uniform diameter throughout. Additionally, the removable longitudinal support members can have a round, oval, square, rectangular, polygonal, irregular, or any other desired cross-section.

The collapsible snowshoes, as described herein, may contain deck materials manufactured from polyethylene, polypropylene, plastic, Mylar, silk, cotton, nylon, Kevlar, polyester, or any other material, whether it is synthetic, natural, woven, or any other type of material. In some embodiments, the thickness of the material may be in the range between about 2 mils and about 30 mils, where 1 mil=1/1000 inches. Alternatively, the thickness may be in the range between about 10 mils and about 20 mils. In some embodiments, the thickness may be about 15 mils.

In the claims provided herein, the steps specified to be taken in a claimed method or process may be carried out in any order without departing from the principles of the invention, except when a temporal or operational sequence is explicitly defined by claim language. Recitation in a claim to the effect that first a step is performed then several other steps are performed shall be taken to mean that the first step is performed before any of the other steps, but the other steps may be performed in any sequence unless a sequence is further specified within the other steps. For example, claim elements that recite "first A, then B, C, and D, and lastly E" shall be construed to mean step A must be first, step E must be last, but steps B, C, and D may be carried out in any sequence between steps A and E and the process of that sequence will still fall within the four corners of the claim.

Furthermore, in the claims provided herein, specified steps may be carried out concurrently unless explicit claim language requires that they be carried out separately or as parts of different processing operations. For example, a claimed step of doing X and a claimed step of doing Y may be conducted simultaneously within a single operation, and the resulting process will be covered by the claim. Thus, a step of doing X, a step of doing Y, and a step of doing Z may be conducted simultaneously within a single process step, or in two separate process steps, or in three separate process steps, and that process will still fall within the four corners of a claim that recites those three steps.

Similarly, except as explicitly required by claim language, a single substance or component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention. Applicants reserve the right to physically incorporate into this specification any and all materials and information from any such patents, applications, publications, scientific articles, web sites, electronically available information, and other referenced materials or documents. Applicants reserve the right to physically incorporate into any part of this document, including any part of the written description, the claims referred to above including but not limited to any original claims.

What is claimed is:

1. A collapsible snowshoe comprising:

a guard member having a first surface and a second surface, wherein the guard member is connected to a front lateral edge of a deck having a first surface, a second surface, a first longitudinal edge, a second longitudinal edge, and a rear lateral edge, two removable straight longitudinal support members, each support member having a front end and a rear end, wherein the deck comprises a first longitudinal sleeve along the entire first longitudinal edge of the deck and a second longitudinal sleeve along the entire second longitudinal edge of the deck for receiving the two removable straight longitudinal support members, wherein the first longitudinal sleeve is parallel to the second longitudinal sleeve, wherein the two removable longitudinal support members each independently contain one or more retainers;

one or more cross members each independently having a first surface, a second surface, a first proximal end, and a second proximal end, wherein the one or more cross members are each independently connected transversely to the first surface of the deck and the first proximal end overlaps the first longitudinal sleeve perpendicular to the first longitudinal sleeve and the second proximal end overlaps the second longitudinal sleeve perpendicular to the second longitudinal sleeve;

a snowshoe binding connected transversely to one or more of the one or more cross members, wherein a front of the snowshoe binding is oriented toward the guard member;

a connector operatively coupling the first surface of the guard member to the snowshoe binding, wherein the connector comprises a connector member, a lanyard, and a lanyard retainer, one or more crampons connected to the second surface of the deck, and wherein the front ends of the longitudinal support members extend forward of each of the one or more cross members, and the rear ends of the longitudinal support members extend rearwardly of the one or more cross members when the collapsible snowshoe is fully assembled.

2. The collapsible snowshoe of claim 1, wherein the one or more retainers include a snap button, a fitted cap, a fitted tube, or a combination thereof.

* * * * *